US011332864B2

(12) United States Patent
Taguchi et al.

(10) Patent No.: US 11,332,864 B2
(45) Date of Patent: May 17, 2022

(54) EMBROIDERY FRAME AND SEWING MACHINE

(71) Applicant: BROTHER KOGYO KABUSHIKI KAISHA, Nagoya (JP)

(72) Inventors: Yuki Taguchi, Chita-gun (JP); Masahiro Hanabusa, Nagoya (JP); Fumihiro Nonobe, Inuyama (JP); Hironori Matsushita, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 73 days.

(21) Appl. No.: 16/820,014

(22) Filed: Mar. 16, 2020

(65) Prior Publication Data

US 2020/0299885 A1 Sep. 24, 2020

(30) Foreign Application Priority Data

Mar. 22, 2019 (JP) ..... JP2019-053998

(51) Int. Cl.
*D05C 9/04* (2006.01)

(52) U.S. Cl.
CPC ..... *D05C 9/04* (2013.01)

(58) Field of Classification Search
CPC ... D05C 9/04; D05C 9/10; D05C 9/12; D05C 9/14; D05C 1/02; D05C 1/04
See application file for complete search history.

(56) References Cited

U.S. PATENT DOCUMENTS 5,992,339 A * 11/1999 Mack ..... D05C 9/04 112/103
8,584,606 B2 * 11/2013 Mack ..... D05C 9/04 112/103
2009/0267277 A1 * 10/2009 Mack ..... B25B 11/002 269/8
2013/0186317 A1 * 7/2013 Kojima ..... D05C 9/04 112/260
2019/0338450 A1 * 11/2019 Kawaguchi ..... D05B 39/00

FOREIGN PATENT DOCUMENTS

FR 2830264 A1 * 4/2003 ..... C14B 1/26
JP 11001860 A * 1/1999
JP H11-061627 A 3/1999
JP 2005-146460 A 6/2005
JP 3205701 U 8/2016

* cited by examiner

*Primary Examiner* — Alissa L Hoey
*Assistant Examiner* — Patrick J. Lynch
(74) *Attorney, Agent, or Firm* — Oliff PLC

(57) ABSTRACT

An embroidery frame includes a first frame and a second frame. The second frame holds an object to be sewn with the first frame. The second frame includes a first member and a second member. The first member includes a plurality of magnets and an annular portion. The annular portion is made of magnetic material. The first member is able to be switched to one of a first position and a second position. The second member includes a plurality of plate members. The plurality of plate members are made of magnetic material. The first position is a position where some of the plurality of magnets faces the gap and a portion of two of the plate members that are adjacent across the gap. The second position is a position where some of the plurality of magnets faces a corresponding one of the plurality of plate members.

7 Claims, 17 Drawing Sheets

EMBROIDERY FRAME AND SEWING MACHINE

CROSS-REFERENCE TO RELATED APPLICATION

This application claims priority to Japanese Patent Application No. 2019-053998 filed on Mar. 22, 2019, the content of which is hereby incorporated by reference.

BACKGROUND

The present disclosure relates to an embroidery frame and a sewing machine.

There exists an embroidery frame that holds cloth by magnetic force. The embroidery frame includes a support frame and a presser frame, and clamps cloth between the support frame and the presser frame using magnetic force. In such an embroidery frame, the holding force required to hold the cloth increases as the thickness of the cloth increases. Because magnetic force is inversely proportional to the square of the distance, the magnetic force of a magnet must be increased to increase the holding force on the cloth.

SUMMARY

If the magnetic force of the magnet is increased, a user will need to work against the strong magnetic force when attaching or removing thin cloth to or from the embroidery frame.

The present disclosure aims to provide an embroidery frame and a sewing machine capable of both improving operability and holding force of an object to be sewn, by enabling the strength of magnetic attraction force to be switched.

Exemplary embodiments provide an embroidery frame includes a first frame and a second frame. The first frame is made of magnetic material. The second frame is formed so as to hold, with the first frame, an object to be sewn. The second frame includes a first member and a second member. The first member includes a plurality of magnets and an annular portion. The plurality of magnets are provided lined up in the circumferential direction on the annular portion. The annular portion is made of magnetic material. The first member is able to be switched to one of a first position and a second position. The second member includes a plurality of plate members. The plurality of plate members are provided lined up with a gap therebetween in the circumferential direction. The plurality of plate members are made of magnetic material. The second member contacts the first member. The first position is a position where at least one of the plurality of magnets faces the gap and a portion of two of the plate members that are adjacent across the gap. The second position is a position where each one of the plurality of magnets faces a corresponding one of the plurality of plate members, and the number of magnet facing gap and the portion of two of the plates is greater in the first position than in the second position. The first member changes the magnetic attraction force of the second frame with respect to the first frame by moving in the circumferential direction with respect to the second member, and switching the position of the first member to one of the first position and the second position.

Exemplary embodiments also provide an embroidery frame includes a first frame and a second frame. The first frame is made of magnetic material. The second frame includes a magnet, a magnetic member, and an operating portion. The operating portion is provided on the magnetic member and moves at least one of the position of the magnet or the orientation of a magnetic pole of the magnet. The magnetic member includes an accommodation portion, a press surface, and a pair of opposing portions. The accommodation portion accommodates the magnet. The press surface presses an object to be sewn against the first frame. The pair of opposing portions are provided between the accommodation portion and the press surface. The pair of opposing face each other across a predetermined gap. The operating portion changes a magnetic attraction force of the second frame with respect to the first frame by moving one of the position of the magnet or the orientation of the magnetic pole of the magnet.

Exemplary embodiments also provide a sewing machine includes the embroidery frame described in claim 1.

BRIEF DESCRIPTION OF THE DRAWINGS

Embodiments of the disclosure will be described below in detail with reference to the accompanying drawings in which.

DETAILED DESCRIPTION

Figure 1:
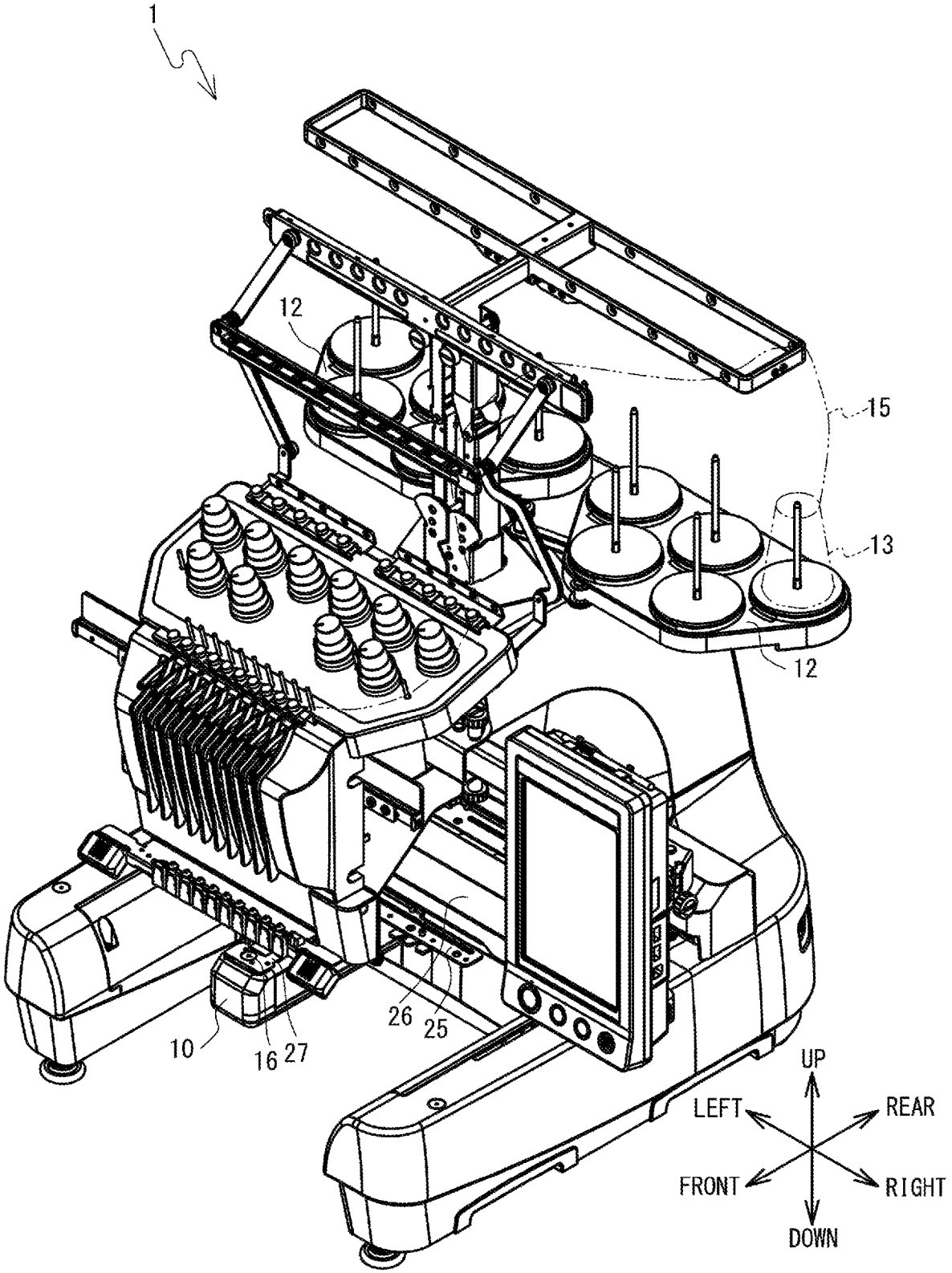
FIG. 1 is a perspective view of a sewing machine.

A first embodiment of the present disclosure will now be described with reference to the drawings. In the description below, the left-right direction, front-rear direction, and up-down direction indicated by the arrows in the drawings will be used.

The configuration of a sewing machine 1 will be described with reference to FIG. 1 and FIG. 2. The sewing machine 1 shown in FIG. 1 is a multi-needle sewing machine. The sewing machine 1 includes 10 needle bars (not shown in the drawings). The one needle bar, of the 10 needle bars, that is in a sewing position is the sewing needle bar that is involved with sewing. A sewing needle (not shown in the drawings) is mounted on the lower end of each needle bar. The sewing machine 1 includes a cylinder bed 10. The cylinder bed 10 has a substantially cylindrical shape that extends in the front-rear direction. A shuttle (not shown in the drawings) is provided inside a tip end portion of the cylinder bed 10. The shuttle houses a bobbin (not shown in the drawings). A lower thread (not shown in the drawings) is wound around the bobbin. A needle plate 27 is provided on the upper surface of the cylinder bed 10. The needle plate 27 includes a needle hole 16. A sewing needle passes through the needle hole 16.

A holder 25, a Y carriage 26, and an X carriage 28 and the like are provided above the cylinder bed 10. The holder 25, the Y carriage 26, and the X carriage 28 form a movement mechanism (not shown in the drawings). As illustrated in FIG. 2, an embroidery frame unit 30 is mounted to the holder 25 via a frame mounting member 31. The embroidery frame unit 30 is provided with an embroidery frame 38 on the front side. The embroidery frame 38 clamps cloth using magnetic force. The movement mechanism can move the embroidery frame unit 30 that is mounted on the holder 25 in the front-rear and left-right directions. As illustrated in FIG. 1, the sewing machine 1 is provided with spool bases 12. Spools 13 are installed on the spool bases 12. Upper threads 15 are supplied from the spools 13. One upper thread 15 is supplied to the eye hole (not shown in the drawings) of each sewing needle. The sewing machine 1 forms a stitch in the cloth by moving the embroidery frame 38 clamping the cloth using the movement mechanism, and driving the sewing needle bar up and down and rotatably driving the shuttle.

The configuration of the embroidery frame unit 30 will now be described with reference to FIG. 2 and FIG. 3. The embroidery frame unit 30 is provided with the embroidery frame 38 and a mounting portion 45. The embroidery frame unit 30 can be mounted to the frame mounting member 31. The frame mounting member 31 is detachably fixed to the holder 25 of the sewing machine 1. The embroidery frame 38 is formed in an annular shape in a plan view. The embroidery frame 38 includes a lower frame 40 and an upper frame 50. The embroidery frame 38 can clamp the cloth between the lower frame 40 and the upper frame 50 using magnetic force. Note that the specific configuration of the embroidery frame 38 will be described later. The mounting portion 45 is fixed to a rear portion of the lower frame 40. The mounting portion 45 is detachably mounted to the frame mounting member 31 that is fixed to the holder 25.

Figure 3:
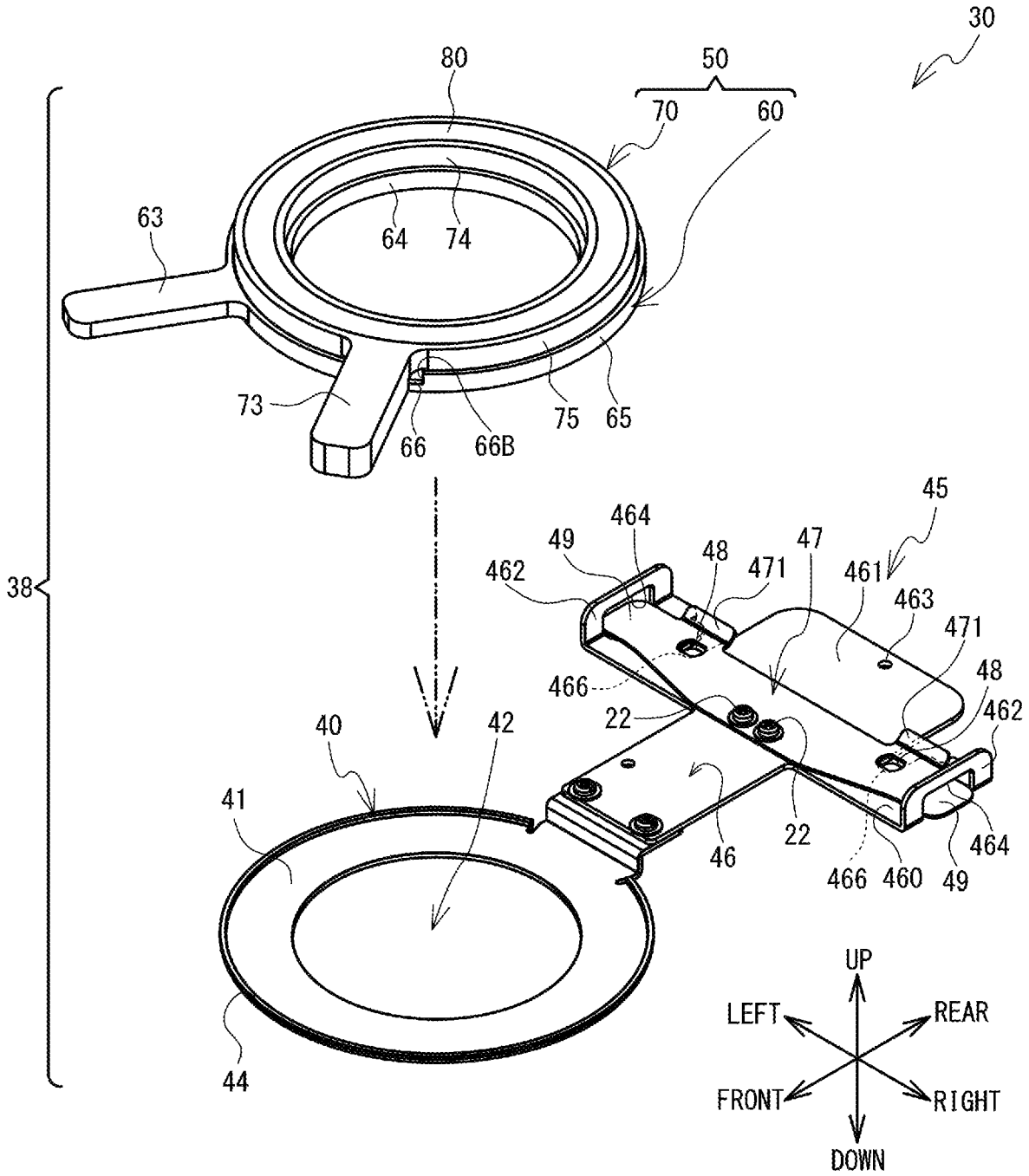
FIG. 3 is an exploded perspective view of the embroidery frame unit.

As illustrated in FIG. 3, the mounting portion 45 has an attachment plate portion 46 and a positioning member 47. The attachment plate portion 46 is connected to a rear portion of the lower frame 40 and extends toward the rear. The attachment plate portion 46 has a transverse portion 460 and a rectangular portion 461. The transverse portion 460 extends in the left-right direction from substantially the center in the front-rear direction of the attachment plate portion 46, and is formed in a substantially rectangular shape in a plan view. An insertion portion 462 is provided on both the left end portion and the right end portion of the transverse portion 460. The insertion portion 462 is formed by bending the left end portion or the right end portion of the transverse portion 460 upward. Each insertion portion 462 has a hole 464. The hole 464 passes through the insertion portion 462 in the left-right direction. The rectangular portion 461 is provided on the rear portion of the attachment plate portion 46, and is formed in a substantially rectangular shape in a plan view. A protruding portion 463 is provided on the rear end side, and in the center in the left-right direction, on the lower surface of the rectangular portion 461. The protruding portion 463 protrudes downward. A pair of grooves 466 are provided on a portion where the left and right end portions of the rectangular portion 461 and the rear end portion of the transverse portion 460 intersect. The pair of grooves 466 extend forward. The pair of grooves 466 have a width that enables a pair of pins 35, described later, of the frame mounting member 31 to be inserted therein.

The positioning member 47 defines the mounting position of the mounting portion 45 with respect to the frame mounting member 31. The positioning member 47 extends in the left-right direction. The positioning member 47 is a flexible leaf spring. The center portion in the left-right direction of the positioning member 47 is fixed to the center portion in the left-right direction of the upper surface of the attachment plate portion 46 using two screws 22. The positioning member 47 is provided with a pair of engagement holes 48 and a pair of grasping portions 49. The pair of engagement holes 48 are provided on both the left and right end sides of the positioning member 47. The pair of grooves 466 are arranged directly below the pair of engagement holes 48. The pair of grooves 466 are provided on the attachment plate portion 46. The pair of pins 35, described later, of the frame mounting member 31 are inserted into the pair of engagement holes 48 from below, and are able to engage therewith. The pair of grasping portions 49 are provided on both the left and right end sides of the positioning member 47. The pair of grasping portions 49 are inserted through the pair of holes 464. The pair of holes 464 are provided in the pair of insertion portions 462 of the transverse portion 460. The user can bend both the left and right end portions of the positioning member 47 upward with respect to the upper surface of the transverse portion 460 by pushing the pair of grasping portions 49 upward. A pair of inclined portions 471 are provided on both the left and right end sides of the rear end portion of the positioning member 47. The pair of inclined portions 471 are formed in a substantially rectangular plate shape in a plan view, and are inclined diagonally upward toward the rear.

Figure 2:
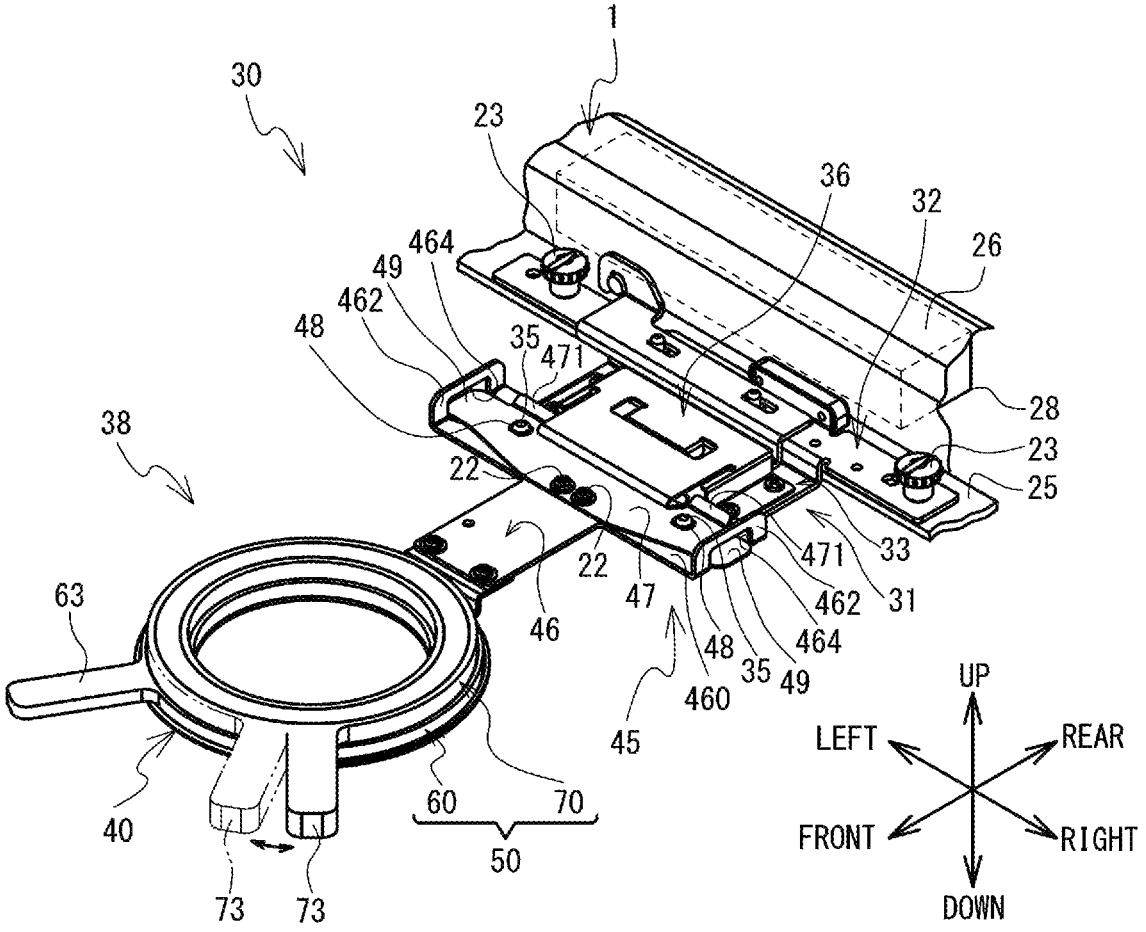
FIG. 2 is a perspective view of an embroidery frame unit mounted, via a frame mounting member, to a holder of the sewing machine according to a first embodiment.

As illustrated in FIG. 2, the frame mounting member 31 has a portion 32 to be fixed and a forward extending portion 33. The portion 32 to be fixed is formed in a plate shape that extends in the left-right direction. The portion 32 to be fixed is fixed to the holder 25 by a pair of thumb screws 23.

The forward extending portion 33 extends forward from substantially the center of the front end portion of the portion 32 to be fixed. The forward extending portion 33 is formed in a substantially rectangular shape in a plan view. The pair of pins 35 that protrude upward are provided on the right front corner portion and the left front corner portion of the upper surface of the forward extending portion 33. The pins 35 protrudes upward. A chamfered portion is provided on the upper end of the pins 35. The chamfered portion is a portion where the ridge line that is the boundary between the upper end and the outer peripheral surface is chamfered in a substantially hemispherical shape. The frame mounting member 31 includes a pressing member 36 on the upper surface side of the forward extending portion 33. The pressing member 36 is a flexible leaf spring. Both the left and right end portions of the pressing member 36 are bent in a general crank shape in a front view. The pressing member 36 is formed in a substantially rectangular shape that is long in the left-right direction in a plan view. Both the left and right end portions of the pressing member 36 are fixed to the upper surface of the forward extending portion 33 by screws. A pressing portion (not shown in the drawings) is provided on the front end of the pressing member 36. The pressing portion bends downward toward the rear. Two pressing pieces (not shown in the drawings) are provided on an upper wall portion of the pressing member 36. The two pressing pieces protrude downward. The pressing portion and the two pressing pieces of the pressing member 36 contact the upper surface of the rectangular portion 461 of the attachment plate portion 46 and press the rectangular portion 461 toward the forward extending portion 33 side.

The method for mounting the mounting portion 45 of the embroidery frame 38 to the frame mounting member 31 will now be described. The user moves the mounting portion 45 horizontally rearward toward the frame mounting member 31. The user places the rear end of the rectangular portion 461 between the pair of pins 35, inserts the rear end of the rectangular portion 461 between the forward extending portion 33 and the pressing member 36, and pushes the rear end of the rectangular portion 461 in toward the rear. When the mounting portion 45 moves to the rear, the pair of grooves 466 moved rearward while being guided by the pair of pins 35. When the mounting portion 45 moves farther to the rear, the pair of inclined portions 471 of the positioning member 47 come into contact with the chamfered portions of the pair of pins 35. When the mounting portion 45 continues to move to the rear, the pair of pins 35 push the pair of inclined portions 471 upward. As a result, the positioning member 47 bends and elastically deforms such that both the left and right end portions bend upward. Consequently, the positioning member 47 moves toward the rear while contacting the chamfered portion on the upper end of each of the pair of pins 35.

When the user moves the mounting portion 45 even farther to the rear, the front ends of the grooves 466 abut against the side surfaces of the pins 35. As a result, movement of the attachment plate portion 46 toward the rear is restricted, such that the attachment plate portion 46 is positioned in the mounting position. At this time, the pair of engagement holes 48 provided in the positioning member 47 are positioned above the pair of pins 35 provided on the forward extending portion 33. Therefore, the elastically deformed positioning member 47 returns to its original flat plate shape from the bent state by its own elastic force. The pair of engagement holes 48 engage with the pair of pins 35. As a result, the position in the horizontal direction of the embroidery frame 38 is fixed to the frame mounting member 31 via the mounting portion 45. The rectangular portion 461 of the attachment plate portion 46 is inserted inside the pressing member 36. The pressing portion and the two pressing pieces of the pressing member 36 urge the rectangular portion 461 of the attachment plate portion 46 toward the forward extending portion 33 side (downward). As a result, the attachment plate portion 46 is clamped between the pressing member 36 and the forward extending portion 33, so the position thereof in the up-down direction is fixed. Therefore, the mounting portion 45 is mounted to the frame mounting member 31, and attached to the holder 25 of the sewing machine 1.

When detaching the embroidery frame 38 from the frame mounting member 31, the user lifts the pair of grasping portions 49 of the mounting portion 45 upward. When the pair of grasping portions 49 are lifted upward, both of the left and right end portions of the positioning member 47 bend upward. The pair of engagement holes 48 in the positioning member 47 come up off of the pair of pins 35. As a result, the attachment plate portion 46 is able to move forward. Therefore, the user can detach the embroidery frame 38 from the frame mounting member 31.

The configuration of the embroidery frame 38 will now be described with reference to FIG. 2 to FIG. 4. As illustrated in FIG. 2 and FIG. 3, the embroidery frame 38 includes the lower frame 40 and the upper frame 50. The lower frame 40 is mounted, via the mounting portion 45, to the frame mounting member 31 that is fixed to the holder 25. The lower frame 40 is a support frame that supports, from below, cloth to be clamped. The upper frame 50 is a presser frame that holds the cloth against the lower frame 40 from above. The upper frame 50 attracts the lower frame 40 with magnetic force. The upper frame 50 is formed by two components, i.e., a base frame 60 and a rotating frame 70, which will be described later. The upper frame 50 can switch the strength of the magnetic attraction force. Note that "magnetic attraction force" means force to attract an object with magnetic force.

The configuration of the lower frame 40 will now be described with reference to FIG. 3. The lower frame 40 has an annular shape in a plan view. The lower frame 40 is made of magnetic material such as iron, for example. A hole 42 is provided in the center of the lower frame 40. The hole 42 passes through the center of the lower frame 40 in the up-down direction. The hole 42 is formed in a circular shape in a plan view. A clamping surface 41 is provided on the upper surface of the lower frame 40. The clamping surface 41 has a substantially annular shape in a plan view. The clamping surface 41 contacts the lower surface of the cloth. Note that an uneven surface with tiny irregularities to prevent the cloth from slipping, for example, is preferably formed on the clamping surface 41. An outer peripheral wall 44 is provided on an outer peripheral edge portion of the clamping surface 41. The outer peripheral wall 44 protrudes upward in a rib shape. The outer peripheral wall 44 is a reinforcement rib, and keeps the clamping surface 41 flat by suppressing deformation of the clamping surface 41. The front end portion of the attachment plate portion 46 of the mounting portion 45 is fixed to the rear portion of the lower frame 40.

The configuration of the upper frame 50 will now be described with reference to FIG. 3 to FIG. 4. As illustrated in FIG. 3, the upper frame 50 has an annular shape in a plan view, and includes the base frame 60 and the rotating frame 70. The base frame 60 is disposed on the lower side, and the rotating frame 70 is disposed on the upper side. The base frame 60 and the rotating frame 70 are attracted to each other by magnetic force, and the rotating frame 70 can move in the circumferential direction with respect to the base frame 60.

Figure 4:
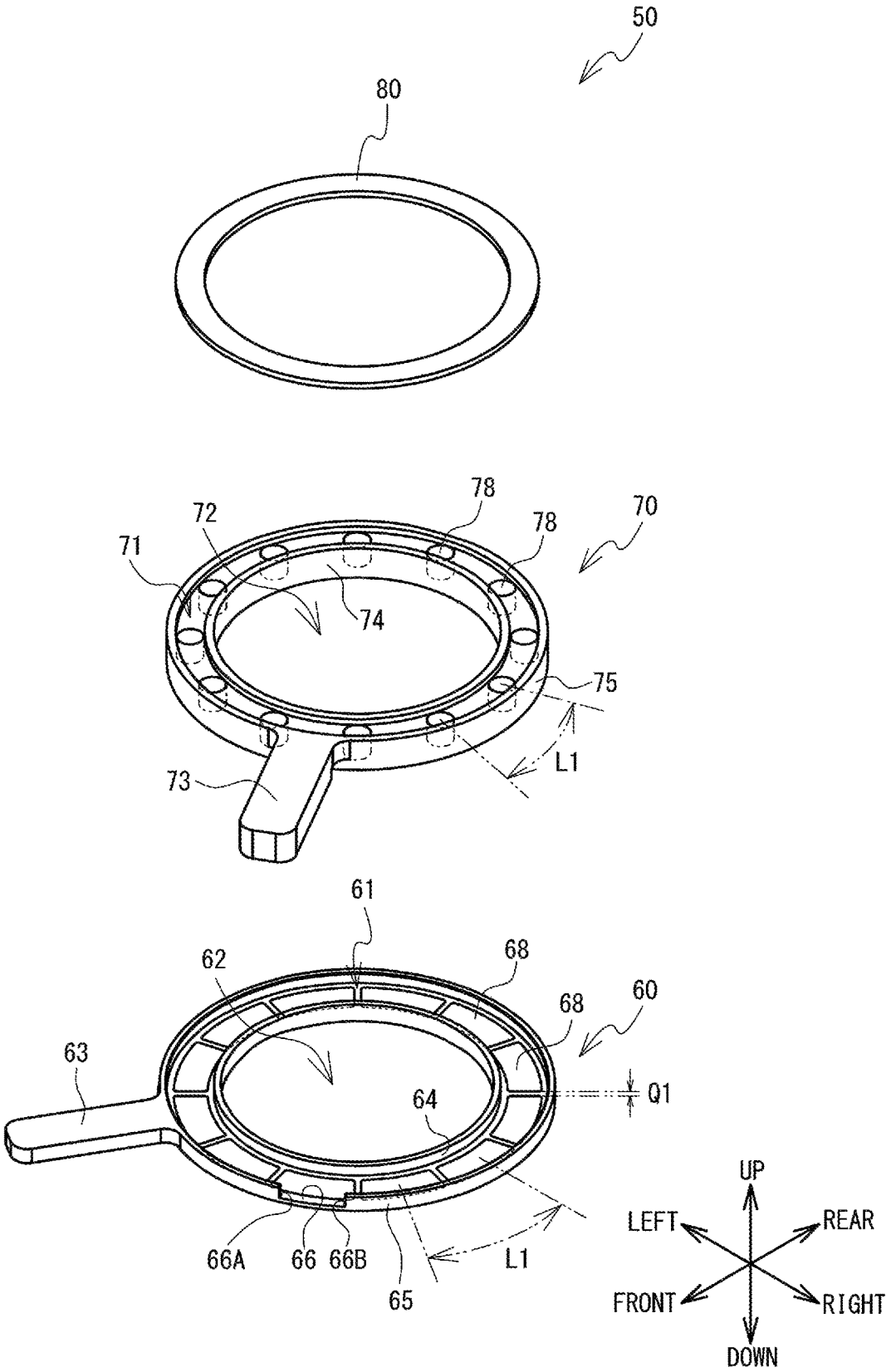
FIG. 4 is an exploded perspective view of an upper frame.

As illustrated in FIG. 4, the base frame 60 includes a resin frame portion 61. The frame portion 61 is formed in an annular shape in a plan view. A hole 62 is provided in the center of the frame portion 61. The hole 62 passes through the center of frame portion 61 in the up-down direction. A grasping portion 63 is provided on the left front portion of the frame portion 61. The grasping portion 63 protrudes in a flat bar shape from the left front portion of the frame portion 61 outward in the radial direction. The frame portion 61 has a width that enables a frame portion 71, described later, of the rotating frame 70 to be placed on the upper surface thereof. An inner peripheral wall 64 is provided on an inner peripheral portion of the frame portion 61, and an outer peripheral wall 65 is provided on an outer peripheral portion of the frame portion 61. The inner peripheral wall 64 and the outer peripheral wall 65 protrude upward in a rib shape. A recessed portion 66 that has been cut away in a substantially rectangular shape is provided on the right front portion of the outer peripheral wall 65. A first engaging portion 66A is provided on the end portion on the downstream side, in the clockwise direction in a plan view, of the end portions of the recessed portion 66, and a second engaging portion 66B is provided on the end portion on the upstream side, in the clockwise direction in a plan view, of the end portions of the recessed portion 66.

Twelve metal plate portions 68 are provided lined up at equidistant intervals in the circumferential direction on the upper surface of the frame portion 61. The metal plate portions 68 are substantially fan-shaped in a plan view. A size of the metal plate portion 68 in the circumferential direction is larger than a size of a magnet 78, described later, in the circumferential direction. These 12 metal plate portions 68 are disposed evenly every predetermined distance (refer to L1 in FIG. 4) in the circumferential direction. The predetermined distance means the distance between the centers of two adjacent metal plate portions 68 in the circumferential direction, for example. The metal plate portions 68 are made of magnetic material such as iron, for example, and function as a yoke. A predetermined gap Q1 (refer to FIG. 4 and FIG. 6) is provided between each two adjacent metal plate portions 68, of the 12 metal plate portions 68.

The rotating frame 70 includes the resin frame portion 71. The frame portion 71 is formed in an annular shape in a plan view. A hole 72 is provided in the center of the frame portion 71. The hole 72 passes through the center of the frame portion 71 in the up-down direction. A grasping portion 73 is provided on the right front portion of the frame portion 71. The grasping portion 73 protrudes in a flat bar shape from the right front portion of the frame portion 71 outward in the radial direction. The grasping portion 73 is thicker than the grasping portion 63 of the base frame 60. A depressed portion 79 (refer to FIG. 5 and FIG. 6) is provided at the base portion on the lower surface of the grasping portion 73. The depressed portion 79 is depressed in a general arc shape from the right surface of the grasping portion 73 toward the left. The depressed portion 79 is such that the second engaging portion 66B of the outer peripheral wall 65 of the base frame 60 is able to be inserted therein. An engagable portion 791 is provided on the far side of the depressed portion 79. The engagable portion 791 is able to engage with the second engaging portion 66B.

Figure 7:
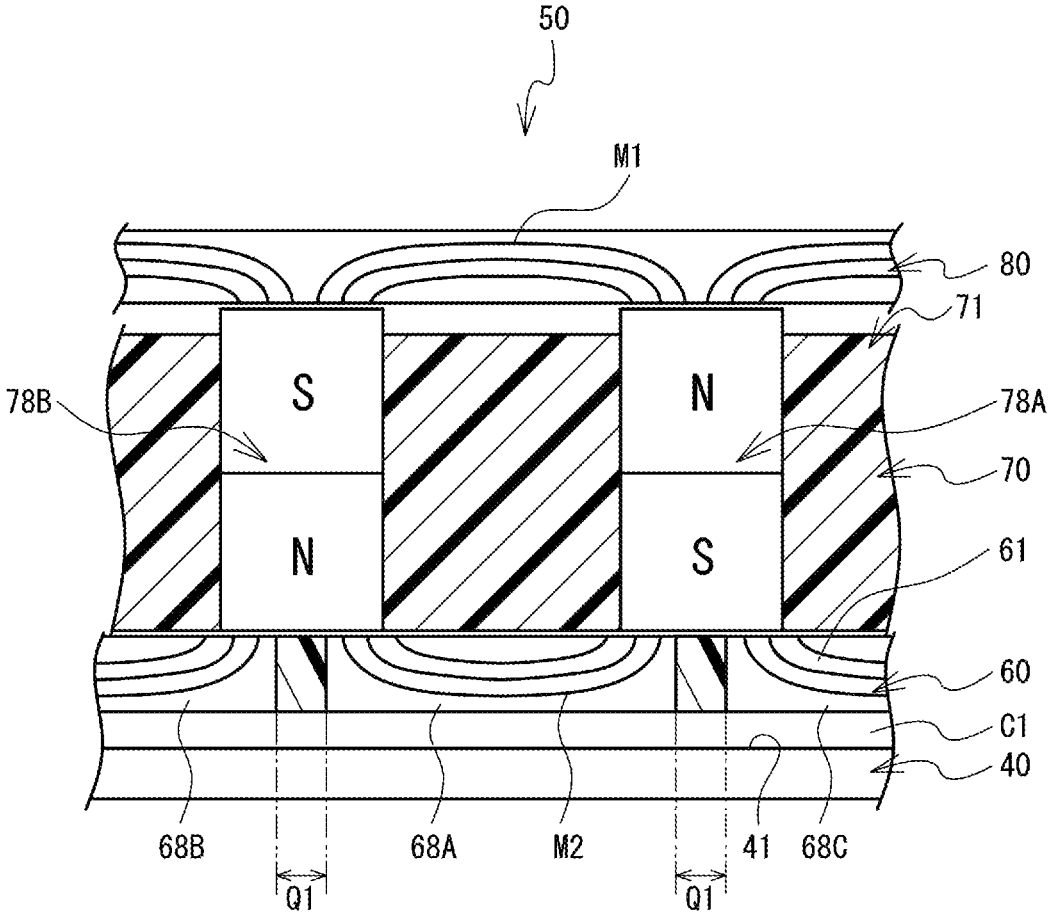
FIG. 7 is a view of a magnetic field in the weak magnetic state.

An inner peripheral wall 74 is provided on an inner peripheral edge portion of the frame portion 71. An outer peripheral wall 75 is provided on an outer peripheral edge portion of the frame portion 71. The inner peripheral wall 74 and the outer peripheral wall 75 protrude upward in a rib shape. The 12 magnets 78 are provided embedded, lined up at equidistant intervals in the circumferential direction, in the upper surface of the frame portion 71. The magnets 78 have a substantially cylindrical shape. These 12 magnets 78 are disposed evenly every predetermined distance (refer to L1 in FIG. 4) in the circumferential direction. The 12 magnets 78 are arranged lined up such that the orientation of the magnetic poles of each of these 12 magnets 78 is parallel to the direction facing the base frame 60 positioned below, and reverses alternately in the circumferential direction of the rotating frame 70. For example, as illustrated in FIG. 7, if, in two magnets 78A and 78B that are adjacent to each other, the upper side of the magnet 78A is the N pole and the lower side is the S pole, then the magnetic poles of the adjacent magnet 78B are reversed such that the upper side of the magnet 78B is the S pole and the lower side of the magnet 78B is the N pole. Therefore, the embroidery frame 38 is able to better form a magnetic field between the adjacent magnets 78A and 78B along the annular upper frame 50.

As illustrated in FIG. 4, the upper portion of each of the 12 magnets 78 protrudes upward from the upper surface of the frame portion 71. The lower portions of the magnets 78 may be exposed on the lower surface of the frame portion 71. An annular portion 80, for example, is fixed by magnetic force to the upper portions of the 12 magnets 78. The annular portion 80 is made of magnetic material such as iron. The annular portion 80 is disposed between the inner peripheral wall 74 and the outer peripheral wall 75 (refer to FIG. 3).

The rotating frame 70 is fixed to the upper surface of the frame portion 61 of the base frame 60 by the magnetic force of the 12 magnets 78. The base portion of the grasping portion 73 of the rotating frame 70 is disposed inside the recessed portion 66 of the outer peripheral wall 65 of the base frame 60 (refer to FIG. 3). Therefore, the grasping portion 73 will not interfere with the outer peripheral wall 65. Thus, the lower surface of the frame portion 71 can closely contact the upper surface of the frame portion 61. In this case, the user can grasp and rotate the grasping portion 73 of the rotating frame 70 while fixing the position of the base frame 60 with the grasping portion 63. Therefore, the user can easily and stably move the rotating frame 70 in the circumferential direction with respect to the upper surface of the base frame 60.

The rotating frame 70 can move in the circumferential direction between a weak magnetic position and a strong magnetic position, with respect to the base frame 60. The weak magnetic position is a position of the rotating frame 70 when the magnetic force of the upper frame 50 that attracts the lower frame 40 is weak (hereinafter, referred to as "weak magnetic state"). The strong magnetic position is a position of the rotating frame 70 when the magnetic force of the upper frame 50 that attracts the lower frame 40 is strong (hereinafter, referred to as "strong magnetic state").

Figure 5:
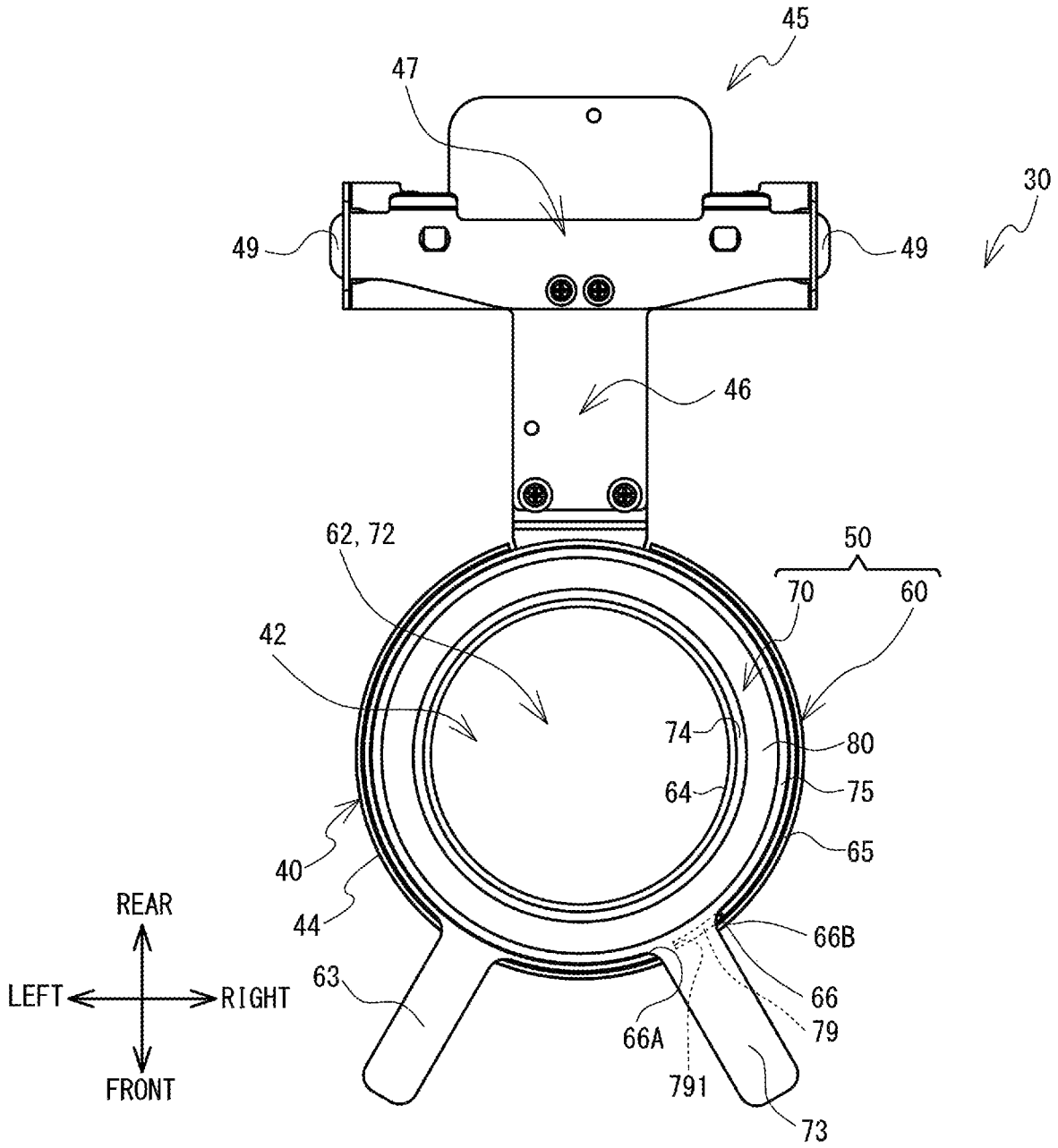
FIG. 5 is a plan view of the embroidery frame unit (in a weak magnetic state)
Figure 6:
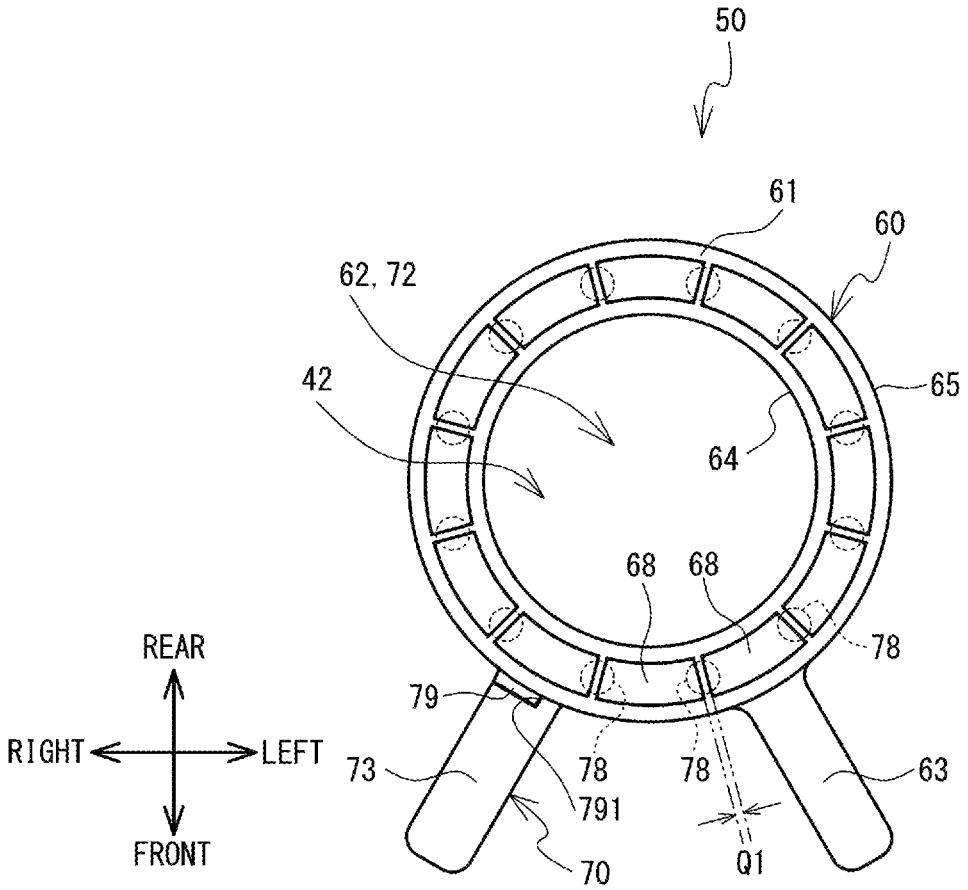
FIG. 6 is a bottom view of the upper frame (in the weak magnetic state)

The weak magnetic position of the rotating frame 70, and the weak magnetic state of the upper frame 50 at that time, will now be described with reference to FIG. 5 to FIG. 7. In FIG. 7, in order to make the magnetic lines of force of the magnetic fields M1 and M2 easier to see, some of the hatching lines indicating cross-sections are omitted. As illustrated in FIG. 5, the user rotates the grasping portion 73 of the rotating frame 70 in the clockwise direction, and engages the left surface of the base portion of the grasping portion 73 of the rotating frame 70 with the first engaging portion 66A of the recessed portion 66 of the base frame 60. At this time, the rotating frame 70 is positioned in the weak magnetic position. As illustrated in FIG. 6 and FIG. 7, each of the 12 magnets 78 faces a predetermined gap Q1 between two adjacent metal plate portions 68, and the end portion of each of the two adjacent metal plate portions 68 that sandwich the predetermined gap Q1.

FIG. 7 illustrates the mutual positional relationship between the two magnets 78A and 78B, and three metal plate portions 68A, 68B, and 68C in the weak magnetic state. Cloth C1 is clamped between the upper frame 50 and the lower frame 40. The orientation of the magnetic poles of each of these magnets 78A and 78B is arranged parallel to the direction facing the base frame 60 positioned below, and alternately reverses in the circumferential direction of the rotating frame 70. The upper side of the magnet 78A is the N pole, and the lower side of the magnet 78A is the S pole. The upper side of the magnet 78B is the S pole, and the lower side of the magnet 78B is the N pole. The annular portion 80 is attracted to the N pole of the magnet 78A by magnetic force. The S pole of the magnet 78A faces the predetermined gap Q1 between the two adjacent metal plate portions 68A and 68C, and the end portions of the two adjacent metal plate portions 68A and 68C that sandwich the predetermined gap Q1. The annular portion 80 is attracted to the S pole of the magnet 78B by magnetic force. The N pole of the magnet 78B faces the predetermined gap Q1 between the two adjacent metal plate portions 68A and 68B, and the end portions of the two adjacent metal plate portions 68A and 68B that sandwich the predetermined gap Q1.

In this state, the magnetic field M1 that passes between the N pole of the magnet 78A and the S pole of the magnet 78B passes through the annular portion 80. The magnetic field M2 that passes between the S pole of the magnet 78A and the N pole of the magnet 78B passes through the corresponding metal plate portion 68A. Therefore, the magnetic field that shifts to the lower frame 40 side is small. In this case, the magnetic force that attracts the clamping surface 41 of the lower frame 40 is weak and is thus in the weak magnetic state.

Figure 8:
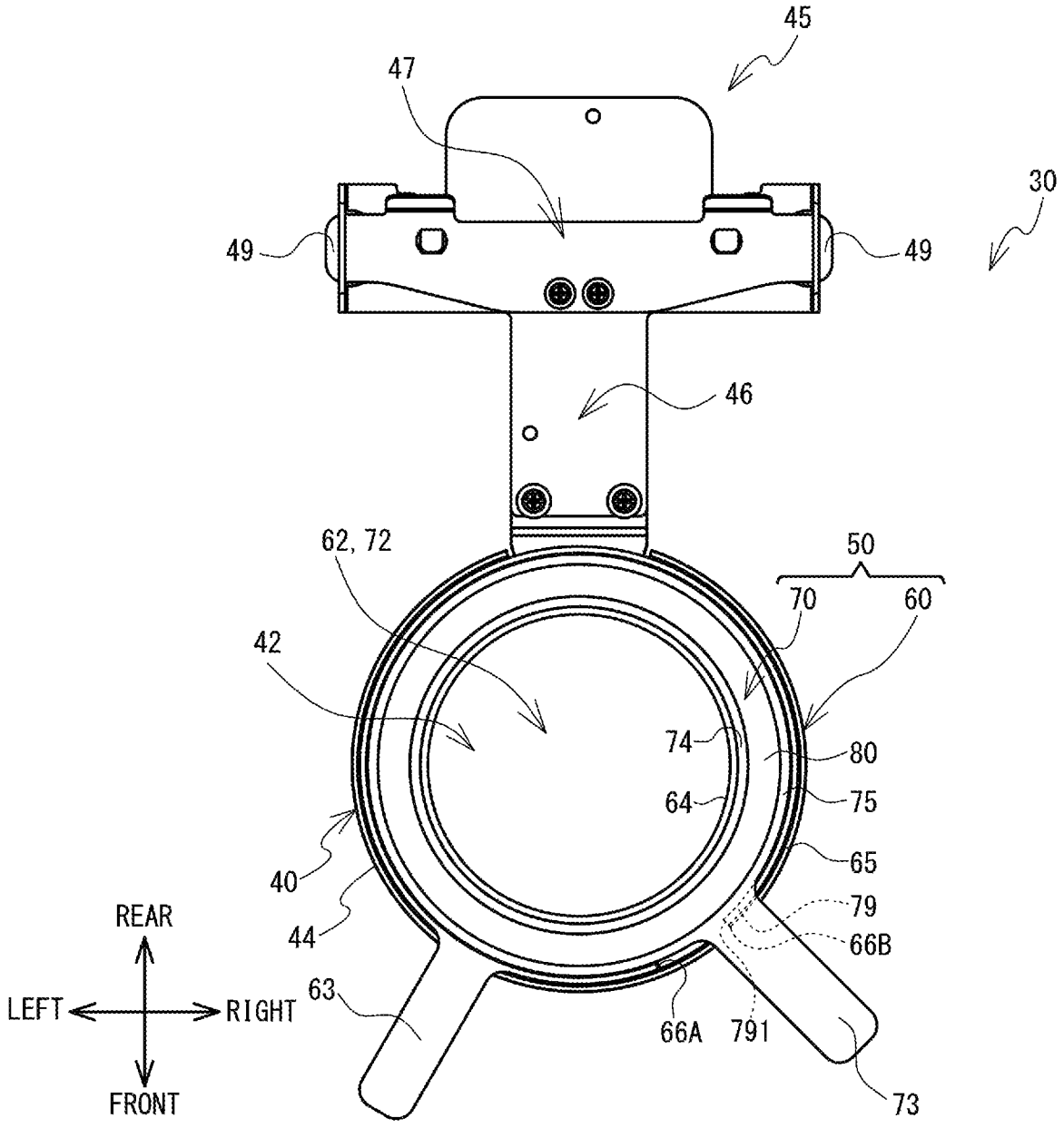
FIG. 8 is a plan view of the embroidery frame unit (in a strong magnetic state)
Figure 9:
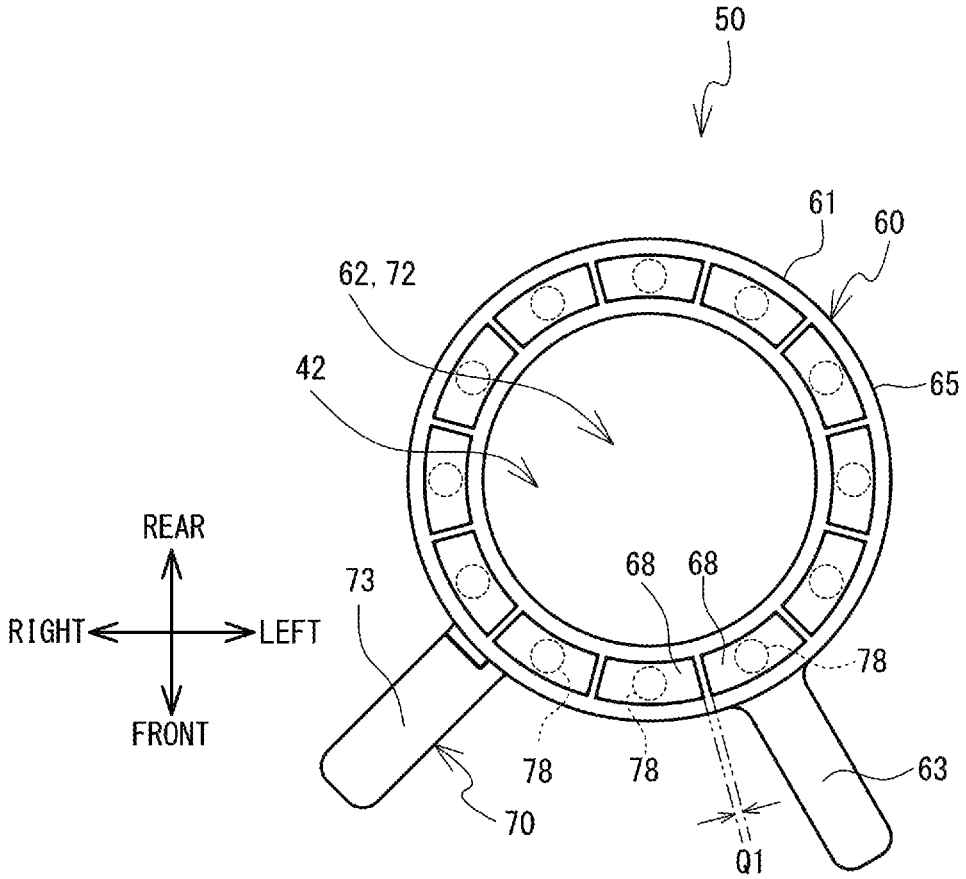
FIG. 9 is a bottom view of the upper frame (in the strong magnetic state)
Figure 10:
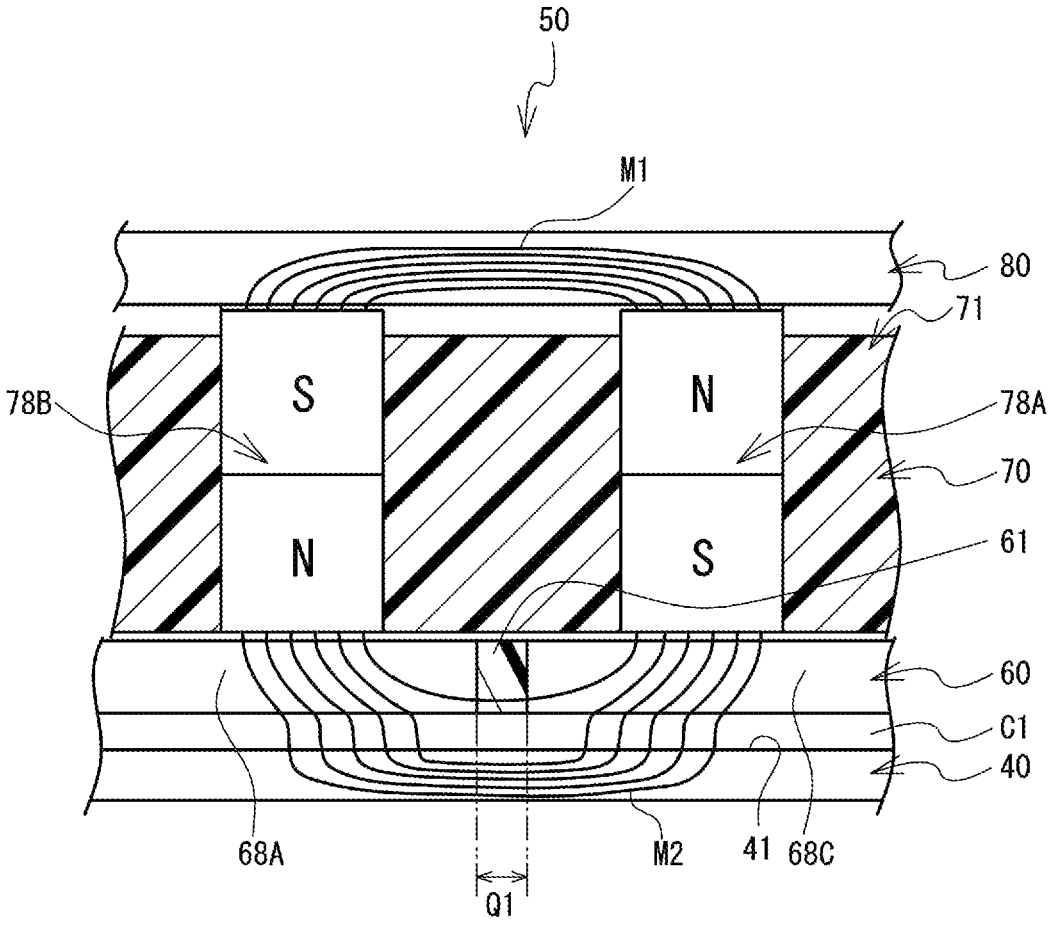
FIG. 10 is a view of a magnetic field in the strong magnetic state.

The strong magnetic position of the rotating frame 70, and the strong magnetic state of the upper frame 50 at that time, will now be described with reference to FIG. 8 to FIG. 10. In FIG. 10, in order to make the magnetic lines of force of the magnetic fields M1 and M2 easier to see, some of the hatching lines indicating cross-sections are omitted. As illustrated in FIG. 8, the user rotates the grasping portion 73 of the rotating frame 70 in the counterclockwise direction, inserts the second engaging portion 66B of the recessed portion 66 of the base frame 60 inside the depressed portion 79 of the grasping portion 73, thereby engaging the second engaging portion 66B with the engagable portion 791. At this time, the rotating frame 70 is positioned in the strong magnetic position. As illustrated in FIG. 9 and FIG. 10, each of the 12 magnets 78 faces one of the 12 metal plate portions 68.

FIG. 10 illustrates the mutual positional relationship between the two magnets 78A and 78B in the strong magnetic state, and the opposing two metal plate portions 68C and 68A. The S pole of the magnet 78A faces the metal plate portion 68C. The N pole of the magnet 78B faces the metal plate portion 68A. In this state, the magnetic field M1 that passes between the N pole of the magnet 78A and the S pole of the magnet 78B passes through the annular portion 80. The magnetic field M2 that passes between the S pole of the magnet 78A and the N pole of the magnet 78B passes through the corresponding two metal plate portions 68C and 68A. The magnetic field M2 shifts to the lower frame 40 side by the predetermined gap Q1 interposed between the metal plate portions 68C and 68A. At this time, the magnetic force that attracts the lower frame 40 is strong and is thus in the strong magnetic state.

The base frame 60 and the rotating frame 70 of the present embodiment are both have an annular shape. Therefore, the user can easily switch the mutual positional relationship between the 12 metal plate portions 68 and the 12 magnets 78 just by rotating the rotating frame 70 with respect to the base frame 60. The user is easily able to switch the rotating frame 70 to either the weak magnetic position or the strong magnetic position by rotating the rotating frame 70 with the grasping portion 73, and engaging this grasping portion 73 with the first engaging portion 66A or the second engaging portion 66B of the base frame 60. Also, the size of the metal plate portion 68 provided in the base frame 60 in the circumferential direction is larger than the size of the magnet 78 provided in the rotating frame 70 in the circumferential direction. Therefore, when the user places the rotating frame 12 in the weak magnetic position, each of the 12 magnets 78 can face the predetermined gap between the two adjacent metal plate portions 68, and the end portion of each of the two adjacent metal plate portions 68 that sandwich the predetermined gap (refer to FIG. 6). Each of the 12 magnets 78 can face one of the 12 metal plate portions 68, when the user places the rotating frame 12 in the strong magnetic position (refer to FIG. 9).

An example of a switching operation to switch the magnetic attraction force of the upper frame 50 when attaching and detaching cloth with respect to the embroidery frame 38 will now be described. For example, when clamping cloth between the lower frame 40 and the upper frame 50, the user first places the cloth on the lower frame 40, and then sets the upper frame 50 to a weak magnetic state by rotating the grasping portion 73 of the rotating frame 70 of the upper frame 50 clockwise and positioning the rotating frame 70 in the weak magnetic position. Then, the user fixes the upper frame 50 to the clamping surface 41 of the lower frame 40 with magnetic force to hold the cloth in place from above. The magnetic force of the upper frame 50 is weak, so when the user brings the upper frame 50 close to the clamping surface 41 of the lower frame 40, the upper frame 50 will not be strongly attracted to the lower frame 40. Therefore, the user is able to slowly and safely bring the upper frame 50 close to the clamping surface 41 of the lower frame 40 while reliably positioning the upper frame 50 with respect to the clamping surface 41 of the lower frame 40. Because the user can slowly press the upper frame 50 down on the cloth that has been arranged on the clamping surface 41 of the lower frame 40, the cloth can be prevented from shifting with respect to the lower frame 40.

After the upper frame 50 is attracted to the clamping surface 41 of the lower frame 40 with the cloth sandwiched therebetween, the user then sets the upper frame 50 to the strong magnetic state by rotating the grasping portion 73 of the rotating frame 70 counterclockwise and positioning the rotating frame 70 in the strong magnetic position. Therefore, because the magnetic force of the upper frame 50 that attracts the lower frame 40 becomes stronger, the embroidery frame 38 can firmly clamp the cloth between the upper frame 50 and the lower frame 40.

Next, an operation performed when removing cloth held in the embroidery frame 38 will be described. When removing upper frame 50 from the lower frame 40 and removing the cloth after sewing using the sewing machine 1 is finished, for example, the user again places the upper frame 50 in the weak magnetic state by rotating the grasping portion 73 clockwise and placing the rotating frame 70 in the weak magnetic position. As a result, the magnetic force of the upper frame 50 becomes weaker, so the user is able to easily remove the upper frame 50 from the lower frame 40 with little force. In this way, the embroidery frame 38 can improve both cloth retention and operability.

As described above, the sewing machine 1 according to the first embodiment detachably supports the embroidery frame unit 30. The embroidery frame unit 30 includes the embroidery frame 38. The embroidery frame 38 includes the annular lower frame 40 and the annular upper frame 50, and can hold the cloth sandwiched in between the lower frame 40 and the upper frame 50. The lower frame 40 is made of magnetic material. The upper frame 50 includes the rotating frame 70 and the base frame 60. The rotating frame 70 includes the annular portion 80 that is made of magnetic material, and the 12 magnets 78. The 12 magnets 78 are provided side by side every predetermined distance in the circumferential direction on the annular portion 80. The base frame 60 includes the 12 metal plate portions 68 that are made of magnetic material. The 12 metal plate portions 68 are provided side by side with a predetermined gap Q1 every predetermined distance in the circumferential direction. While the rotating frame 70 and the base frame 60 are contacting one another, the user moves the rotating frame 70 in the circumferential direction with respect to the base frame 60.

The rotating frame 70 of the upper frame 50 can be switched between the weak magnetic position and the strong magnetic position. The weak magnetic position is a position where each of the 12 magnets 78 faces the predetermined gap Q1 and a portion of each of the two adjacent metal plate portions 68 sandwiching the predetermined gap Q1. The strong magnetic position is a position where each of the 12 magnets 78 faces one of the 12 metal plate portions 68. The embroidery frame 38 can change the magnetic attraction force of the upper frame 50 with respect to the lower frame 40 by switching the position of the rotating frame 70 to either the weak magnetic position or the strong magnetic position.

The user causes the upper frame 50 to attract the lower frame 40 in order to clamp the cloth with the embroidery frame 38. In this case, in the upper frame 50, the user switches the position of the rotating frame 70 to the strong magnetic position. At this time, the magnetic field that passes between the two adjacent magnets 78 passes through the opposing two metal plate portions 68, and shifts to the lower frame 40 side by the predetermined gap Q1 interposed between those two metal plate portions 68. Therefore, because the upper frame 50 can strongly attract the lower frame 40, the embroidery frame 38 can firmly hold the cloth between the upper frame 50 and the lower frame 40.

When removing the upper frame 50 from the lower frame 40, the user switches the position of the rotating frame 70 of the upper frame 50 from the strong magnetic position to the weak magnetic position. At this time, the magnetic field that passes between the two adjacent magnets 78 passes through the corresponding metal plate portion 68. Therefore, the embroidery frame 38 can significantly reduce the magnetic field that shifts to the lower frame 40 side, so the magnetic attraction force of the upper frame 50 with respect to the lower frame 40 can be effectively weakened. Thus, the user is able to easily remove the upper frame 50 from the lower frame 40. As a result, the embroidery frame 38 can improve both cloth retention and operability.

Figure 11:
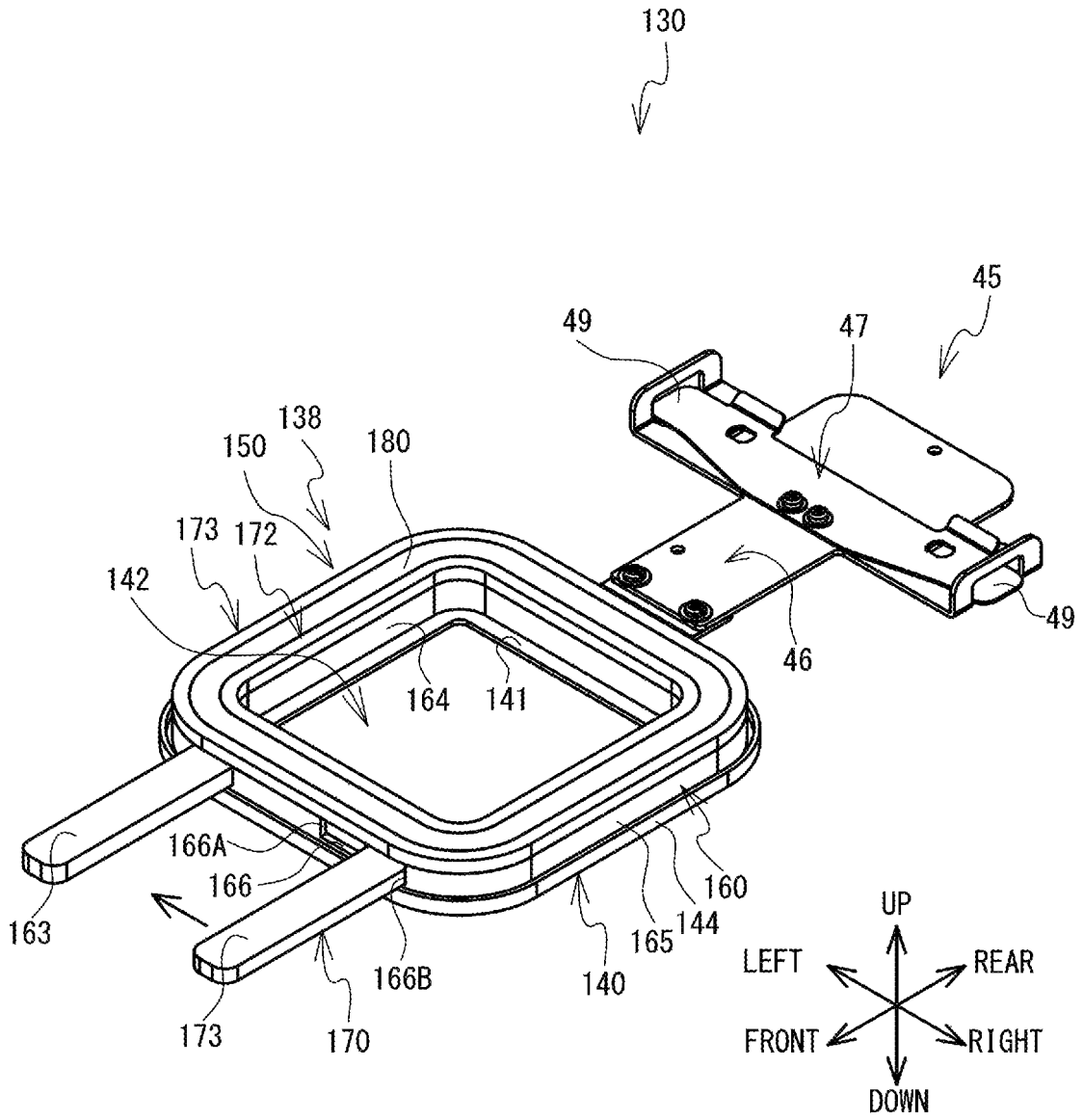
FIG. 11 is a perspective view of an embroidery frame unit according to a second embodiment.

A second embodiment of the present disclosure will now be described with reference to FIG. 11 and FIG. 12. The sewing machine 1 according to the second embodiment is such that an embroidery frame unit 130 can be attached to and detached from the holder 25 (refer to FIG. 1) via the frame mounting member 31 (refer to FIG. 2). The embroidery frame unit 130 is provided with an embroidery frame 138 and the mounting portion 45. The embroidery frame 138 has a different shape from the embroidery frame 38 according to the first embodiment, and is formed in a substantially rectangular shape in a plan view. This mounting portion 45 is similar to the mounting portion 45 according to the first embodiment, so in the present embodiment, the mounting portion 45 will be denoted by the same reference character and a description of the mounting portion 45 will be omitted.

The embroidery frame 138 includes a lower frame 140 and an upper frame 150. The lower frame 140 is mounted, via the mounting portion 45, to the frame mounting member 31 that is fixed to the holder 25. The lower frame 140 is a support frame that supports, from below, cloth to be clamped. The upper frame 150 is a presser frame that holds the cloth against the lower frame 140 from above. The upper frame 150 attracts the lower frame 140 with magnetic force. The upper frame 150 includes a base frame 160 and a rotating frame 170, which will be described later. The rotating frame 170 includes a frame portion 171 that is a flexible member. The user can switch the strength of the magnetic force of the upper frame 150 by moving the rotating frame 170 in the circumferential direction with respect to the base frame 160.

The configuration of the lower frame 140 will now be described. As illustrated in FIG. 12, the lower frame 140 is a frame member having a substantially rectangular shape in a plan view, and is made of magnetic material such as iron, for example. A hole 142 is provided in the center portion of the lower frame 140. The hole 142 passes through the center portion of the lower frame 140 in the up-down direction. The hole 142 is formed in a substantially rectangular shape in a plan view. A clamping surface 141 having a substantially rectangular frame shape in a plan view is provided on the upper surface of the lower frame 140. The clamping surface 141 is a surface that contacts the lower surface of the cloth. An uneven surface with tiny irregularities to prevent the cloth from slipping is preferably formed on the clamping surface 141. An outer peripheral wall 144 is provided on an outer peripheral edge portion of the clamping surface 141. The outer peripheral wall 144 protrudes upward in a rib shape. The outer peripheral wall 144 suppresses deformation of the clamping surface 141. The outer peripheral wall 144 is a reinforcement rib for keeping the clamping surface 141 flat. The front end portion of the attachment plate portion 46 is fixed to the rear end portion of the lower frame 140.

The configuration of the upper frame 150 will now be described. As illustrated in FIG. 11, the upper frame 150 is formed in a substantially rectangular frame shape in a plan view, and includes the base frame 160 and the rotating frame 170. The base frame 160 is disposed on the lower side, and the rotating frame 170 is disposed on the upper side. The base frame 160 and the rotating frame 170 are attracted to each other by magnetic force. The rotating frame 170 can move between the weak magnetic position and the strong magnetic position in the circumferential direction, with respect to the base frame 160.

Figure 12:
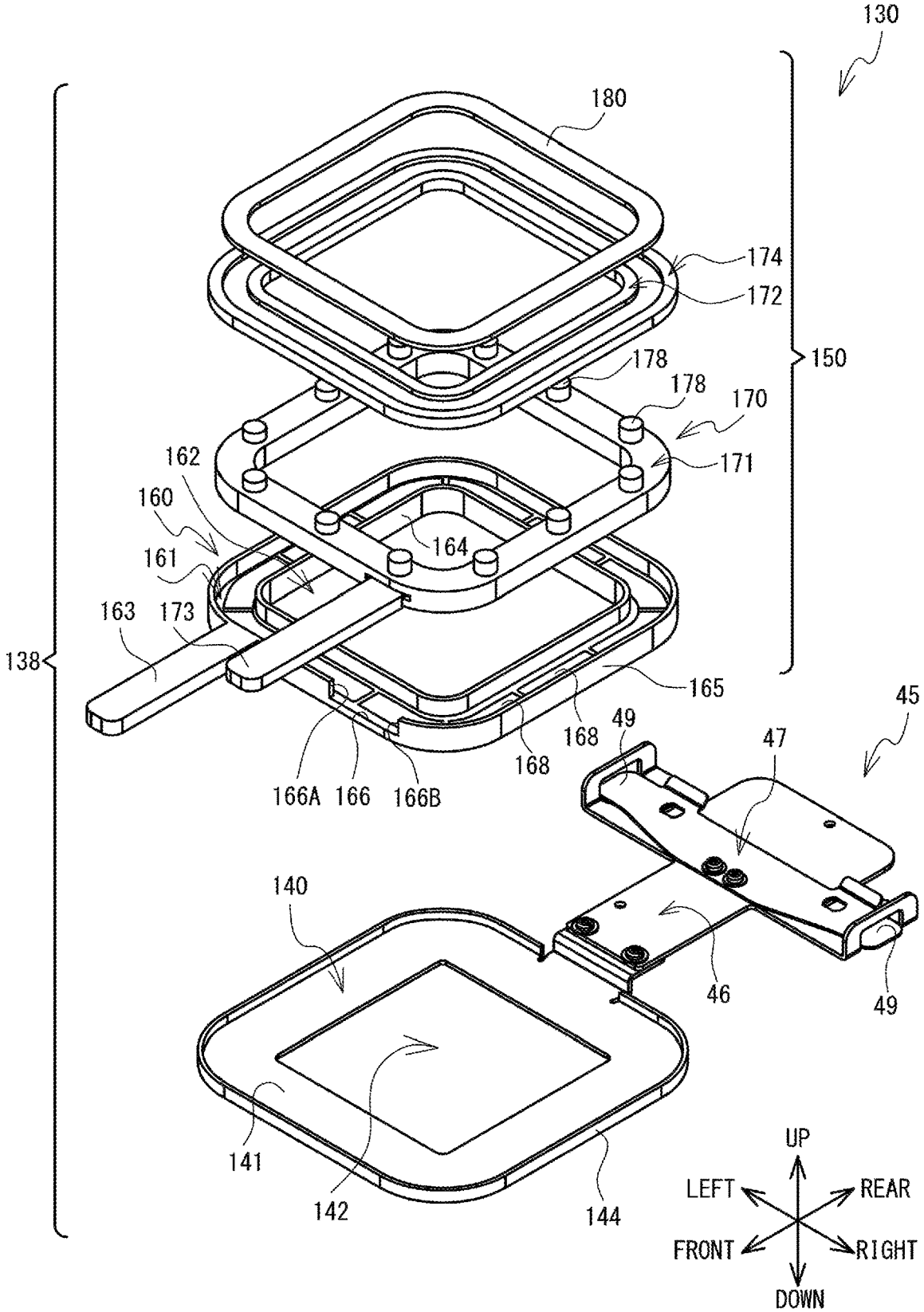
FIG. 12 is an exploded perspective view of the embroidery frame unit.
Figure 13:
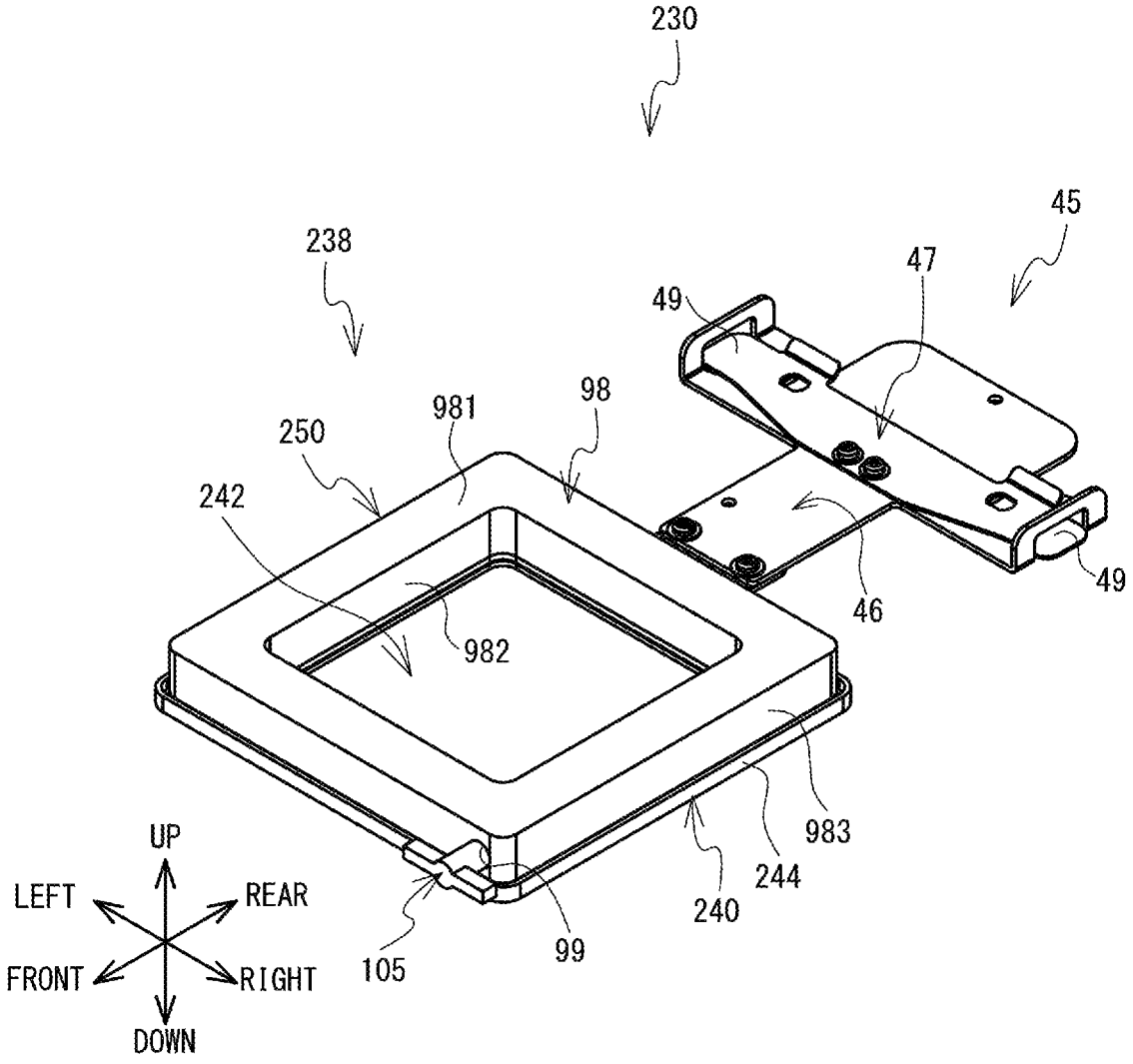
FIG. 13 is a perspective view of an embroidery frame unit according to a third embodiment.

As illustrated in FIG. 12, the base frame 160 includes a resin frame portion 161. The frame portion 161 is formed in a substantially rectangular frame shape in a plan view. A rectangular hole 162 is provided in the center of the frame portion 161. The hole 162 passes through the center of the frame portion 161 in the up-down direction. A grasping portion 163 is provided on the left upper portion of the front surface of the frame portion 161. The grasping portion 163 protrudes forward in a flat bar shape. The upper surface of the frame portion 161 has a width that enables the frame portion 171 of the rotating frame 170 to be placed thereon. An inner peripheral wall 164 is provided on the inner peripheral edge portion of the frame portion 161, and an outer peripheral wall 165 is provided on an outer peripheral edge portion of the frame portion 161. The inner peripheral wall 164 and the outer peripheral wall 165 protrude upward in a rib shape. A recessed portion 166 is provided on the right side of the upper end portion of the front surface of the outer peripheral wall 165. The recessed portion 166 is formed by cutting out the right side of the upper end portion of the front surface of the outer peripheral wall 165 in a substantially rectangular shape. A first engaging portion 166A is provided on the left end portion, among the end portions, of the recessed portion 166, and a second engaging portion 166B is provided on the right end portion, among the end portions, of the recessed portion 166.

Twelve metal plate portions 168, each having a substantially rectangular shape in a plan view, are provided lined up at equidistant intervals in the circumferential direction, every predetermined distance on the upper surface of the frame portion 161. The metal plate portions 168 are made of magnetic material such as iron, for example, and function as a yoke. A predetermined gap is provided between each two adjacent metal plate portions 168, of the 12 metal plate portions 168.

The rotating frame 170 includes the frame portion 171. The frame portion 171 is formed by a flexible member. An elastomer or the like may be applied as the flexible member, for example. The frame portion 171 is formed in an annular shape, but the shape of the frame portion 171 in a plan view can be changed by applying external force to the frame portion 171. A grasping portion 173 is integrally connected to the right front portion of the frame portion 171. The grasping portion 173 is made of resin, and protrudes forward in a flat bar shape. Twelve magnets 178, each having a substantially cylindrical shape, are embedded lined up in the circumferential direction every predetermined distance, in the upper surface of the frame portion 171. These 12 magnets 178 are provided lined up such that the magnetic poles thereof are parallel to the direction facing the base frame 160 positioned below, and are alternately reversed in the circumferential direction of the rotating frame 170, similar to the first embodiment. The 12 magnets 178 protrude upward from the upper surface of the frame portion 171. The lower portions of the magnets 178 may be exposed on the lower surface of the frame portion 171.

The rotating frame 170 is fixed to the upper surface of the base frame 160 by the magnetic force of the 12 magnets 178. The base portion of the grasping portion 173 of the rotating frame 170 is disposed inside the recessed portion 166 of the outer peripheral wall 165 of the base frame 160. Therefore, the grasping portion 173 will not interfere with the outer peripheral wall 165. As a result, in the upper frame 150, the lower surface of the frame portion 171 of the rotating frame 170 can be arranged parallel to, and thus in close contact with, the upper surface of the frame portion 161 of the base frame 160. The user can grasp the grasping portion 173 of the rotating frame 170 and move the grasping portion 173 in the left-right direction while fixing the position of the base frame 160 with the grasping portion 163. The frame portion 171 of the rotating frame 170 is a flexible member, so the frame portion 171 can move in the circumferential direction following the shape of the base frame 160. Therefore, the user can move the rotating frame 170 in the circumferential direction of the base frame 160, with respect to the upper surface of the base frame 160, by moving the grasping portion 173 in the left-right direction.

In the base frame 160 inside of which the rotating frame 170 is arranged, an inner frame portion 172 is mounted to an upper portion of the inner peripheral wall 164, and an outer frame portion 174 is mounted to an upper portion of an outer peripheral wall 165. The inner frame portion 172 is made of resin and has a rectangular frame shape. The outer frame portion 174 is also made of resin and also has a rectangular frame shape. The 12 magnets 178 protrude upward from the upper surface of the frame portion 171 of the rotating frame 170. A rectangular frame-shaped portion 180 is arranged on the upper side of the 12 magnets 178. The rectangular frame-shaped portion 180 is made of magnetic material such as iron, for example. The rectangular frame-shaped portion 180 is supported by the inner frame portion 172 and the outer frame portion 174. The rectangular frame-shaped portion 180 is arranged not contacting the upper surfaces of the 12 magnets 178, but with a small gap therebetween.

The rotating frame 170 can move in the circumferential direction between the weak magnetic position and the strong magnetic position, with respect to the base frame 160. The weak magnetic position is a position where, when the user has moved the grasping portion 173 to the left, the left surface of the base portion of the grasping portion 173 of the rotating frame 170 contacts and engages with the first engaging portion 166A of the recessed portion 166 of the base frame 160. In this state, each of the 12 magnets 178 faces a predetermined gap between two adjacent metal plate portions 168, and end portions of the two adjacent metal plate portions 168 that sandwich the predetermined gap. The strong magnetic position is a position where, when the user has moved the grasping portion 173 to the right from the weak magnetic position, the right surface of the base portion of the grasping portion 173 of the rotating frame 170 contacts and engages with the second engaging portion 166B of the recessed portion 166 of the base frame 160. In this state, each of the 12 magnets 178 faces a corresponding one of the 12 metal plate portions 68.

Therefore, with the embroidery frame 138 according to the second embodiment, the user is able to switch the strength of the magnetic attraction force by operating the grasping portion 173 of the rotating frame 170, and moving the rotating frame 170 to either the weak magnetic position or the strong magnetic position, similar to the embroidery frame 38 according to the first embodiment.

As described above, with the sewing machine 1 according to the second embodiment, the embroidery frame unit 130 can be attached and detached. The embroidery frame unit 130 includes the embroidery frame 138. The embroidery frame 138 is formed in a substantially rectangular shape in a plan view. The upper frame 150 of the embroidery frame 138 is formed in a substantially rectangular frame shape in a plan view, and includes the base frame 160 and the rotating frame 170. The base frame 160 includes the resin frame portion 161. The 12 metal plate portions 168 are provided lined up at equidistant intervals in the circumferential direction every predetermined distance on the upper surface of the frame portion 161. The rotating frame 170 includes the frame portion 171. The frame portion 171 is formed by a flexible member such as an elastomer. The 12 substantially cylindrical magnets 178 are provided lined up at equidistant intervals in the circumferential direction every predetermined distance on the upper surface of the frame portion 171. Because the frame portion 171 is a flexible member, the user can move the rotating frame 170 in the circumferential direction of the base frame 160, with respect to the upper surface of the base frame 160, by moving the grasping portion 173 of the rotating frame 170 in the left-right direction. Therefore, with the embroidery frame 138, the rotating frame 170 can easily be switched between the weak magnetic position and the strong magnetic position, similar to the first embodiment.

A third embodiment of the present disclosure will now be described with reference to FIG. 13 to FIG. 17. The sewing machine 1 according to the third embodiment is such that an embroidery frame unit 230 can be attached to and detached from the holder 25 (refer to FIG. 1) via the frame mounting member 31 (refer to FIG. 2). The embroidery frame unit 230 is provided with an embroidery frame 238 and the mounting portion 45. The embroidery frame 238 is formed in a substantially rectangular shape in a plan view, similar to the embroidery frame 138 according to the second embodiment. Similar to the second embodiment, the mounting portion 45 is similar to the mounting portion 45 according to the first embodiment. Therefore, in the present embodiment as well, the mounting portion 45 will be denoted by the same reference character as in the first embodiment, and a description of the mounting portion 45 will be omitted.

The embroidery frame 238 includes a lower frame 240 and an upper frame 250. The lower frame 240 is mounted, via the mounting portion 45, to the frame mounting member 31 that is fixed to the holder 25. The lower frame 240 is a support frame that supports, from below, cloth to be clamped. The upper frame 250 is a presser frame that holds the cloth against the lower frame 240 from above. The upper frame 250 attracts the lower frame 240 with magnetic force. The upper frame 250 includes four magnet bases 91 to 94, which will be described later. The magnetic attraction force of each of the four magnet bases 91 to 94 of the upper frame 150 with respect to the lower frame 240 can be switched by operating the four magnet bases 91 to 94.

Figure 14:
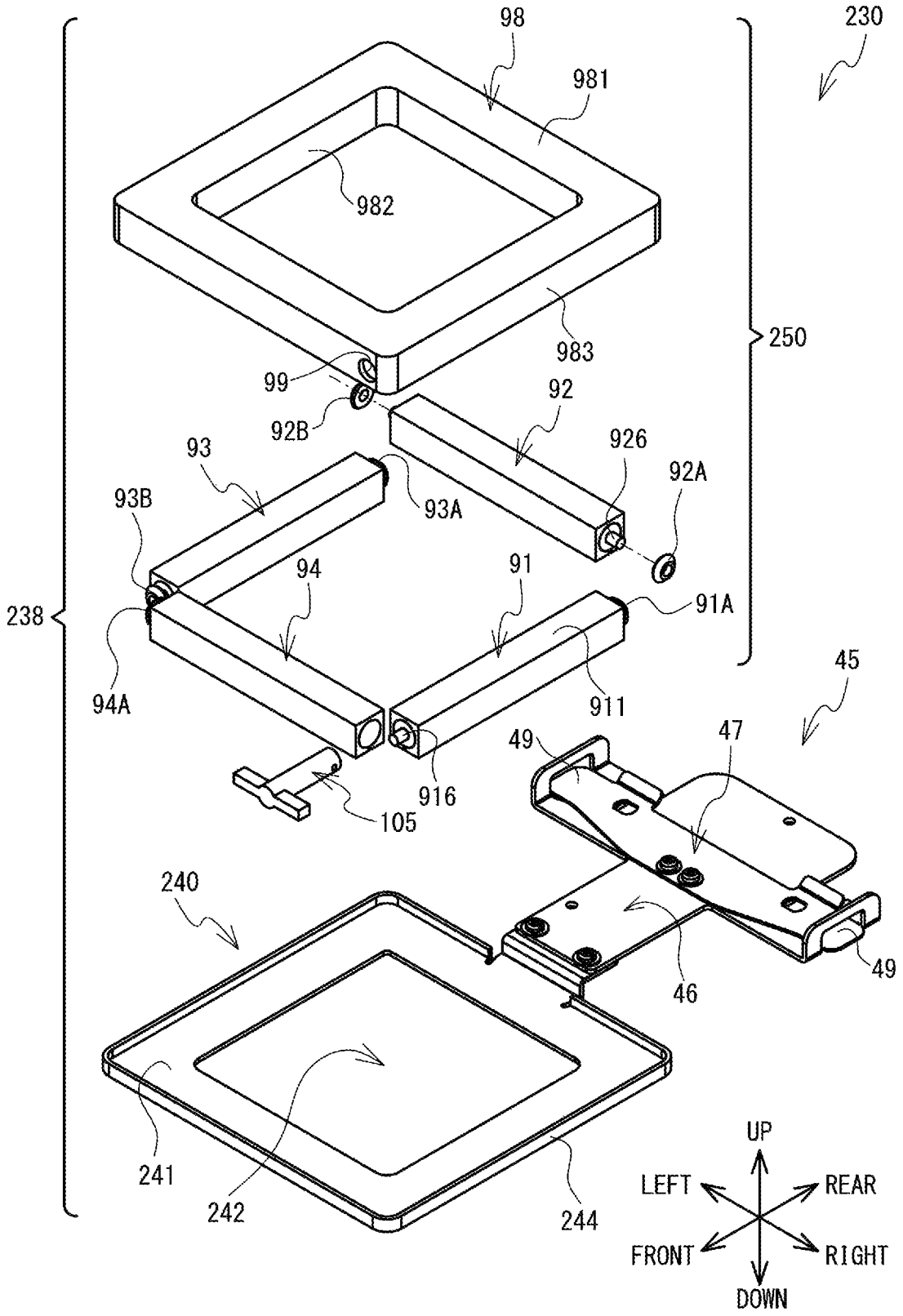
FIG. 14 is an exploded perspective view of the embroidery frame unit.

The configuration of the lower frame 240 will now be described. As illustrated in FIG. 14, the lower frame 240 is a frame member having a substantially rectangular shape in a plan view. The lower frame 240 is made of magnetic material such as iron, for example. A hole 242 is provided in the center of the lower frame 240. The hole 242 passes through the center of the lower frame 240 in the up-down direction. The hole 242 is formed in a substantially rectangular shape in a plan view. A clamping surface 241 is provided on the upper surface of the lower frame 240. The clamping surface 241 has a substantially rectangular frame shape in a plan view. The clamping surface 241 is a surface that contacts the lower surface of the cloth. An uneven surface with tiny irregularities to prevent the cloth from slipping is preferably formed on the clamping surface 241. An outer peripheral wall 244 is provided on an outer peripheral edge portion of the clamping surface 241. The outer peripheral wall 244 protrudes upward in a rib shape. The outer peripheral wall 244 is a reinforcement rib for keeping the clamping surface 241 flat, and inhibits deformation of the clamping surface 241. The front end portion of the attachment plate portion 46 is fixed to the rear end portion of the lower frame 240.

The configuration of the upper frame 250 will now be described. As illustrated in FIG. 14, the upper frame 250 includes the four magnet bases 91 to 94 and a case 98. Each of the magnet bases 91 to 94 is formed long, narrow, substantially rectangular parallelepiped shape. The magnet bases 91 to 94 are devices that can be mutually switched between a demagnetized state and an excited state by moving the orientation of magnets 278 (refer to FIG. 16 and FIG. 17) accommodated therein. The magnet bases 91 to 94 are the same device having a common configuration. The magnet bases 91 to 94 according to the present embodiment are arranged so as to form a substantially rectangular frame. The magnet base 91 is arranged extending in the front-rear direction on the right side of the frame. The magnet base 92 is arranged extending in the left-right direction on the rear side of the frame. The magnet base 93 is arranged extending in the front-rear direction and parallel to the magnet base 91, on the left side of the frame. The magnet base 94 is arranged extending in the left-right direction and parallel to the magnet base 92, on the front side of the frame.

The configuration of the magnet base 91 will now be described. The configurations of the magnet bases 92 to 94 are similar to the configuration of the magnet base 91, so a description thereof will be omitted. The magnet base 91 includes an external portion 911, a magnetic portion 915, a magnet 278, a rotating shaft 916, and a bevel gear 91A, and the like. As illustrated in FIG. 14 to FIG. 17, the external portion 911 is a substantially rectangular parallelepiped-shaped case that is long in the front-rear direction with the bottom portion being open, and is made of resin, for example. The magnetic portion 915 is provided inside the external portion 911, and is formed in a substantially rectangular parallelepiped-shape that is long in the front-rear direction. The magnetic portion 915 is a magnetic member made of iron, for example, and function as a yoke. An accommodation portion 917 is provided in the center portion inside the magnetic portion 915. The cross-section orthogonal to the longitudinal direction of the accommodation portion 917 is substantially circular. The accommodation portion 917 extends in the front-rear direction, and passes through the front end surface and the rear end surface of the magnetic portion 915. The accommodation portion 917 accommodates the magnet 278.

Figure 16:
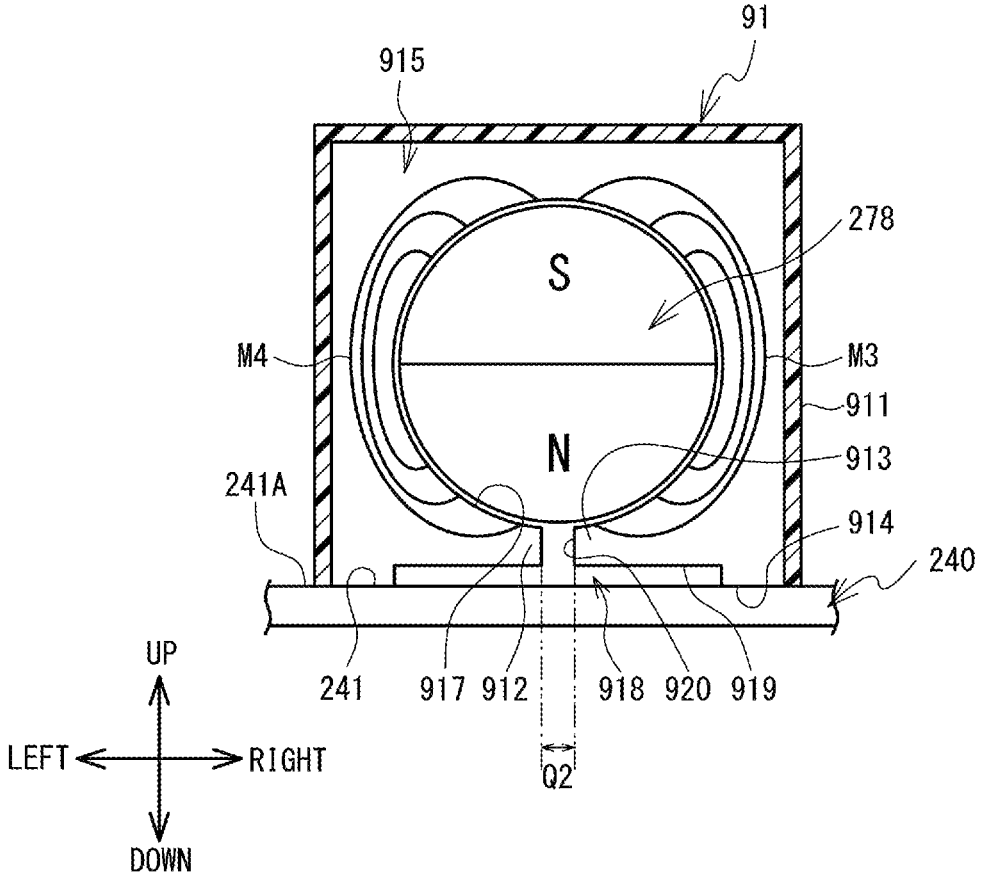
FIG. 16 is a sectional view of the magnet base (in a demagnetized state)
Figure 17:
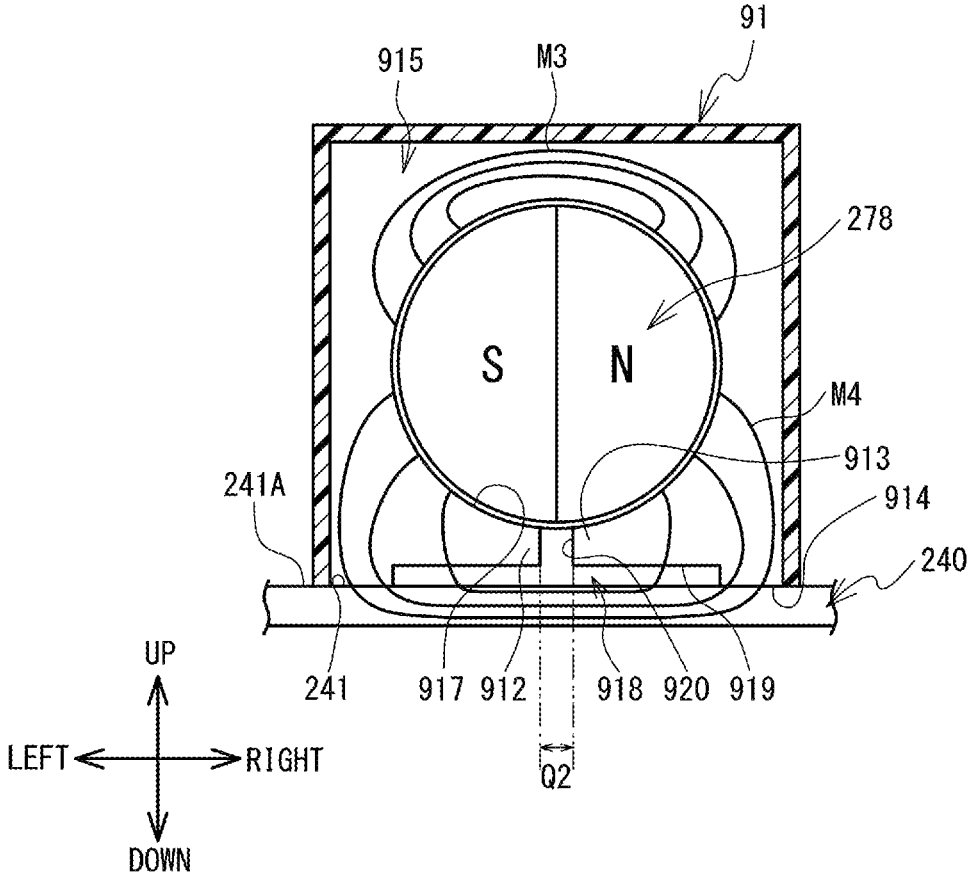
FIG. 17 is a sectional view of the magnet base (in an excited state).

As illustrated in FIG. 16 and FIG. 17, a press surface 914 is formed on the bottom surface of the magnetic portion 915. The press surface 914 is a surface that presses on the cloth. A groove 918 is provided on the press surface 914. The cross-section of the groove 918 is an inverted T-shape. The groove 918 is communicated with the accommodation portion 917. The groove 918 includes a bottom groove portion 919 and a communication portion 920. The bottom groove portion 919 is provided on the press surface 914, and is formed in a substantially rectangular shape that is long in the front-rear direction in a bottom view. The communication portion 920 is provided along the front-rear direction in the center portion in the left-right direction of the bottom groove portion 919. The communication portion 920 is narrower than the bottom groove portion 919 and is communicated with the lower portion of the accommodation portion 917. The width of the communication portion 920 forms a predetermined gap Q2. Therefore, a pair of facing portions 912 and 913 that face each other via the predetermined gap Q2 are formed on the magnetic portion 915.

The magnet 278 is formed in a substantially cylindrical shape that extends in the front-rear direction, and is accommodated in the accommodation portion 917. The rotating shaft 916 (refer to FIG. 14 and FIG. 15) protrudes in the axial direction from the front end surface and the rear end surface of the magnet 278. A front end portion of the rotating shaft 916 protrudes forward from the center of the front end surface of the external portion 911, and is rotatably supported. A rear end portion of the rotating shaft 916 protrudes rearward from the center of the rear end surface of the external portion 911, and is rotatably supported. Therefore, the magnet 278 is supported in a manner able to rotate about the rotating shaft 916, inside the accommodation portion 917. The orientation of the magnetic poles of the magnet 278 inside the accommodation portion 917 is parallel to the direction orthogonal to the center axis of the magnet 278. With the magnet base 91, the orientation of the magnetic poles can be changed by rotating the magnet 278 in the accommodation portion 917 via the rotating shaft 916. The bevel gear 91A is fixed to the rear end portion of the rotating shaft 916.

Figure 15:
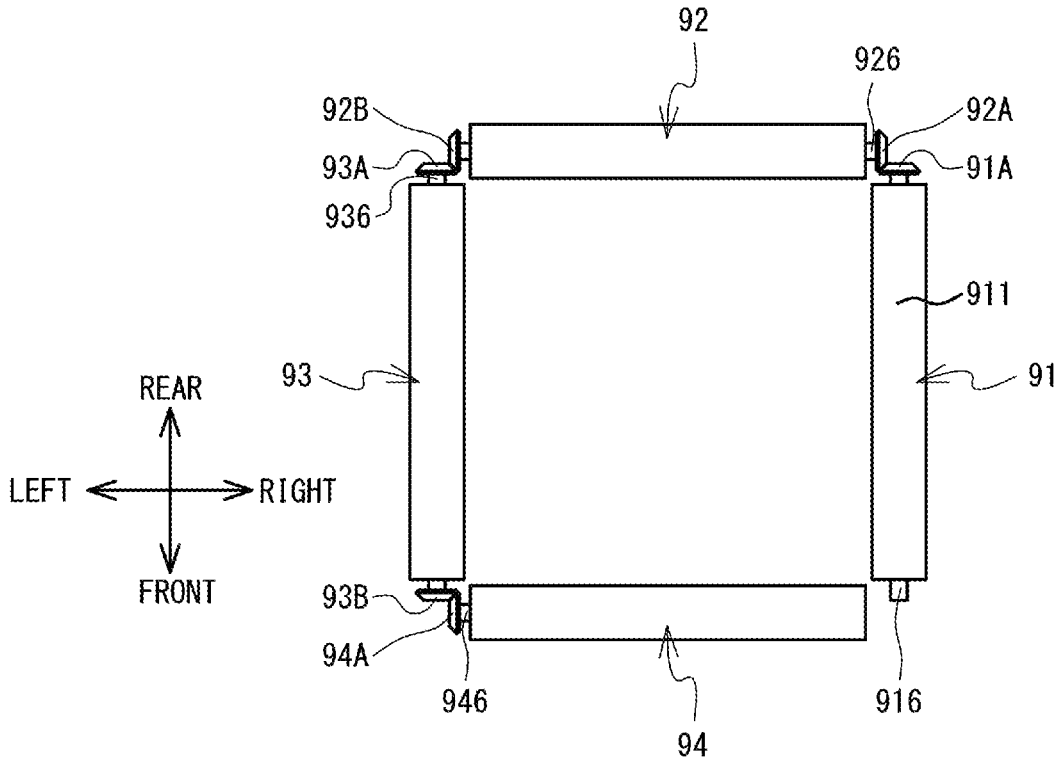
FIG. 15 is a plan view of a magnet base.

As illustrated in FIG. 15, a right end portion of a rotating shaft 926 protrudes from the right end portion of the magnet base 92. A bevel gear 92A is fixed to the right end portion of the rotating shaft 926. The bevel gear 92A meshes with the bevel gear 91A of the magnet base 91. A left end portion of the rotating shaft 926 protrudes from the left end portion of the magnet base 92. A bevel gear 92B is fixed to the left end portion of the rotating shaft 926. A rear end portion of a rotating shaft 936 protrudes from the rear end portion of the magnet base 93. A bevel gear 93A is fixed to the rear end portion of the rotating shaft 936. The bevel gear 93A meshes with the bevel gear 92B of the magnet base 92. A front end portion of the rotating shaft 936 protrudes from the front end portion of the magnet base 93. A bevel gear 93B is fixed to the front end portion of the rotating shaft 936. A left end portion of a rotating shaft 946 protrudes from the left end portion of the magnet base 94. A bevel gear 94A is fixed to the left end portion of the rotating shaft 946. The bevel gear 94A meshes with the bevel gear 93B of the magnet base 93. These bevel gears 91A to 94A, 92B, and 93B transmit the rotational force of the rotating shaft 916 of the magnet base 91 to the rotating shafts 926, 936, and 946 of the magnet bases 92 to 94, respectively.

As illustrated in FIG. 14, the case 98 is formed in a substantially rectangular frame shape in a plan view, with the bottom portion side being open. The case 98 is provided with an upper wall portion 981, an inner peripheral wall portion 982, and an outer peripheral wall portion 983. The upper wall portion 981 is formed in a substantially rectangular frame shape in a plan view. The inner peripheral wall portion 982 protrudes downward in a rib shape along the inner peripheral edge portion of the upper wall portion 981. The outer peripheral wall portion 983 protrudes downward in a rib shape along the outer peripheral edge portion of the upper wall portion 981. The case 98 houses therein the four magnet bases 91 to 94. The upper surface of each of the magnet bases 91 to 94 is fixed by adhesive or a screw (not shown in the drawings) to the lower surface of the upper wall portion 981 of the case 98. The height positions of the lower surfaces of the magnet bases 91 to 94 are the same. A through-hole 99 is provided in the right side of the front wall portion of the outer peripheral wall portion 983. The through-hole 99 has a circular shape, and passes through the right side of the front wall portion of the outer peripheral wall portion 983 in the front-rear direction. The through-hole is opposite the rotating shaft 916. The rotating shaft 916 protrudes toward the front side of the magnet base 91. An operating lever 105 is inserted from the outside (front) into the through-hole 99. The operating lever 105 is formed in a substantially T-shape in a plan view. The operating lever 105 is fixed by a screw (not shown in the drawings) to the front end portion of the rotating shaft 916. Therefore, the user can rotate the rotating shaft 916 by rotating the operating lever 105. Note that the operating lever 105 may be configured to be able to be inserted and taken out, instead of being fixed to the rotating shaft 916.

The mechanism for switching the strength of the magnetic force of the magnet base 91 will be described with reference to FIG. 16 and FIG. 17. FIG. 16 and FIG. 17 illustrate a state in which the clamping surface 241 of the lower frame 240 is arranged below the press surface 914 of the magnet base 91. The magnet base 91 can be switched to either a demagnetized state or an excited state by rotating the orientation of the magnet poles of the magnet 278. Note that the demagnetized state means a weak magnetic force state, and the excited state means a strong magnetic force state.

As illustrated in FIG. 16, with the magnet base 91 in the demagnetized state, the orientation of the magnetic poles of the magnet 278 faces in the vertical direction. That is, the N pole is on the bottom and the S pole is on the top, or vice versa. Magnetic fields M3 and M4 are magnetic fields that go from the N pole of the magnet 278 toward the S pole of the magnet 278. In this state, the magnetic fields M3 and M4 both pass through the inside of the magnetic portion 915, but do not pass through the predetermined gap Q2. At this time, the magnetic force that attracts the lower frame 240 is weak, so the magnet base 91 is in the demagnetized state. Therefore, the upper frame 250 can weaken the magnetic attraction force of the magnet base 91 with respect to the lower frame 240.

As illustrated in FIG. 17, with the magnet base 91 in the excited state, the orientation of the magnetic poles of the magnet 278 faces in the horizontal direction. That is, the N pole is on the right and the S pole is on the left, or vice versa. In this state, of the magnetic fields that go from the N pole of the magnet 278 to the S pole of the magnet 278, the magnetic field M3 that passes above the magnet 278 passes through the inside of the magnetic portion 915. Part of the magnetic field M4 that passes below the magnet 278 shifts to the lower frame 240 side due to the predetermined gap Q2 between the pair of facing portions 912 and 913. At this time, the magnet base 91 is in the excited state, so the magnetic force that attracts the lower frame 240 is strong. Therefore, the upper frame 250 can strengthen the magnetic attraction force of the magnet base 91 with respect to the lower frame 240. As described above, the magnet base 91 can be switched between the demagnetized state and the excited state by rotating the magnet 278 90 degrees.

Note that the switching operation between the demagnetized state and the excited state of each of the magnet bases 91 to 94 can be performed at once using the operating lever 105. The user rotates the operating lever 105 to rotate the rotating shaft 916. The rotational force of the rotating shaft 916 of the magnet base 91 is transmitted to the rotating shaft 926 of the magnet base 92 by the bevel gears 91A and 92A. The rotational force of the rotating shaft 926 of the magnet base 92 is transmitted to the rotating shaft 936 of the magnet base 93 by the bevel gears 92B and 93A. The rotational force of the rotating shaft 936 of the magnet base 93 is transmitted to the rotating shaft 946 of the magnet base 94 by the bevel gears 93B and 94A. Therefore, the user can perform the switching operation between the demagnetized state and the excited state of each of the magnet bases 91 to 94 at once using the operating lever 105.

As described above, with the sewing machine 1 according to the third embodiment, the embroidery frame unit 230 can be attached and detached. The embroidery frame unit 230 includes the embroidery frame 238. The embroidery frame 238 is formed in a substantially rectangular shape in a plan view. The upper frame 250 of the embroidery frame 238 is formed in a substantially rectangular frame shape in a plan view, and includes the four magnet bases 91 to 94. The magnet bases 91 to 94 can be switched to either the demagnetized state or the excited state by changing the orientation of the magnet poles of the magnets 278 accommodated therein. Therefore, with the embroidery frame 138, the strength of the magnetic attraction force can easily be switched, similar to the first and second embodiments.

The embroidery frame of the present disclosure is not limited to the embodiments described above; various modifications may be made without departing from the scope of the present disclosure.

The embroidery frames 38, 138, and 238 of the embodiments described above are configured to be mounted to the holder 25 of the sewing machine 1 via the frame mounting member 31, but they may also be configured to be directly mounted to the holder 25. Also, the embroidery frames 38, 138, and 238 do not have to include the mounting portion 45.

The embroidery frame 38 of the first embodiment is provided with 12 metal plate portions 68 and 12 magnets 78. The number of the metal plate portions 68 and the number of the magnets 78 may be changed freely as long as they are plural, but the same number of each is preferable. The gap between the two adjacent metal plate portions 68 and the gap between the two adjacent magnets 78 are preferably the same distance. Therefore, with the embroidery frame 38, the mutual positional relationship between the 12 metal plate portions 68 and the 12 magnets 78 can be collectively changed simply by rotating the rotating frame 70 relative to the base frame 60. The same modification as in the first embodiment can be made in the second embodiment as well. In some cases, the number of the metal plate portion 68 is different from the number of the magnet 78. In this case, the number of the magnet 78 that faces the predetermined gap Q1 and a portion of each of the two adjacent metal plate portions 68 sandwiching the predetermined gap Q1 when the rotating frame 70 is positioned in the strong magnetic position is smaller than that when the rotating frame 70 is positioned in the weak magnetic position. And, the number of the magnet 78 that faces the metal plate portion 68 when the rotating frame 70 is positioned in the strong magnetic position is greater than that when the rotating frame 70 is positioned in the weak magnetic position.

With the embroidery frame 38, the upper frame 50 is formed by the base frame 60 and the rotating frame 70, and the strength of the magnetic force of the upper frame 50 can be switched. With the embroidery frame, the configurations of the upper frame 50 and the lower frame 40 may switched. That is, the lower frame may be formed by a base frame and a rotating frame, and the strength of the magnetic force of the lower frame may be able to be switched.

The upper frame 50 of the embroidery frame 38 includes the base frame 60 and the rotating frame 70, and the plurality of metal plate portions 68 are provided on the base frame 60, and the plurality of magnets 78 are provided on the rotating frame 70. The upper frame may alternatively be such that a plurality of magnets are provided on the base frame 60, and a plurality of metal plate portions are provided on the rotating frame 70, for example.

With the upper frame 50 of the embroidery frame 38, the shape, length, and thickness and the like of each of the grasping portions 63 of the base frame 60 and the grasping portion 73 of the rotating frame 70 can be modified as appropriate. Also, one or both of the grasping portions 63 and 73 may be omitted. Also, instead of the grasping portions 63 and 73, an uneven surface for the user to hold by hand may be provided on the surface of the outer peripheral wall 65 of the base frame 60 and on the surface of the outer peripheral wall 75 of the rotating frame 70, for example.

The positions of the grasping portion 63 and the grasping portion 73 of the embroidery frame 38 may be changed. However, if the grasping portion 63 and the grasping portion 73 are too far apart from one another, or protrude to in the left-right direction, they may collide with other members located around the embroidery frame 38. Therefore, the grasping portion 63 and the grasping portion 73 are preferably positioned on the front side of the embroidery frame 38, for example, and more preferably, protrude in an inverse V-shape when viewed in a plan view. In this case, the grasping portion 63 and the grasping portion 73 are easier to grasp by hand, so operability of the embroidery frame improves.

The embroidery frame 138 of the second embodiment has a rectangular frame shape. Because the frame portion 171 of the rotating frame 170 is a flexible member, the shape of the base frame 160 may be a shape other than a rectangular frame, such as an annular shape, an elliptical shape, a triangular frame shape, or a polygonal frame shape, for example, as long as the frame portion 171 can move.

The embroidery frame 238 of the third embodiment is formed in a rectangular frame shape, and includes the four magnet bases 91 to 94 according to this shape, but the number of magnet bases is not limited to four. For example, the magnet base 94 on the front side and the magnet base 92 on the rear side may be omitted, and just the magnet base 91 on the right side and the magnet base 93 on the left side may be provided. In this case, an operating lever may be attached to each of the magnet base 91 on the right side and the magnet base 93 on the left side, and these magnet bases 91 and 93 may be able to be operated individually by operating these operating levers.

Also, the shape of the embroidery frame 238 is not limited to a rectangular frame shape, and may be an annular shape, an elliptical shape, a triangular frame shape, or a polygonal frame shape, for example. The number, size, and length in the longitudinal direction of the magnet bases may be determined, as appropriate, according to the shape of the embroidery frame 238. For example, if the embroidery frame has a triangular frame shape, at least three magnet bases should be provided according to this shape.

With the embroidery frame 238, it is assumed that the bottom surface of the four magnet bases 91 to 94 are press surfaces that press the cloth. The embroidery frame may be such that one piece of metal plate is arranged on the bottom surface side of each of the four magnet bases 91 to 94, and the bottom surface side of the case 98 is fixed so as to be closed off by the metal plate, such that the metal plate fixed to the bottom surface of the case 98 serves as the press surface that presses the cloth.

With the magnet base 91, the magnetic field is changed by rotating the rotating shaft 916 with the operating lever 105 to rotate the magnet 278 in the accommodation portion 917 via the rotating shaft 916, which moves the orientation of the magnetic poles. The magnet base may change the magnetic field by moving the position of the magnet 278 in the axial direction of the rotating shaft 916 instead of by rotating the magnet 278, for example.

The material of the object to be sewn is not limited as long as it is flexible sheet material that can be sewn. The material of the object to be sewn may be, for example, cloth, leather, or resin sheet, or the like. The cloth may be non-woven cloth. The shape of the object to be sewn is also not limited.

Note that the embroidery frame of the present disclosure may be provided with an upper frame and a lower frame that are both formed in an annular shape, and may be able to clamp and hold an object to be sewn between the lower frame and the upper frame, wherein the lower frame may be made of flexible material, and the upper frame may include a magnet base that has magnets and is able to switch between a demagnetized state and an excited state by moving the position of the magnets or the orientation of the magnetic poles of the magnets, and the magnetic attraction force of the upper frame with respect to the lower frame may be changed by operation of the magnet base.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An embroidery frame comprising:

a first frame made of magnetic material; and a second frame formed so as to hold, with the first frame, an object to be sewn, wherein the second frame includes a first member in which a plurality of magnets are provided lined up in a circumferential direction on an annular portion made of magnetic material, and that is able to be switched to one of a first position and a second position, and a second member in which a plurality of plate members made of magnetic material are provided lined up with a gap therebetween in the circumferential direction, and that contacts the first member, the first position is a position where at least one of the plurality of magnets faces the gap and a portion of two of the plate members that are adjacent across the gap, the second position is a position where some of the plurality of magnets faces a corresponding one of the plurality of plate members, and a number of the plurality of magnets facing the gap and the portion of two of the plates is greater in the first position than in the second position, and the first member changes the magnetic attraction force of the second frame with respect to the first frame by moving in the circumferential direction with respect to the second member, and switching the position of the first member to one of the first position and the second position.

2. The embroidery frame according to claim 1, wherein the plurality of magnets are provided lined up such that the magnetic poles are parallel to a direction facing the second member and reverse alternately in the circumferential direction.

3. The embroidery frame according to claim 1, wherein the first member includes a first protruding portion that protrudes radially outward, and the second member includes a first engaging portion that engages with the first protruding portion at the first position when the first member is moved one of clockwise or counter-clockwise in the circumferential direction, and a second engaging portion that engages with the first protruding portion at the second position when the first member is moved the other of the clockwise or counter-clockwise in the circumferential direction.

4. The embroidery frame according to claim 3, wherein the second member includes a second protruding portion that protrudes radially outward.

5. The embroidery frame according to claim 1, wherein the first member and the second member are formed in an annular shape.

6. The embroidery frame according to claim 1, wherein the size of one of the plate members in the circumferential direction is larger than the size of one of the plurality of magnets in the circumferential direction.

7. A sewing machine comprising the embroidery frame described in claim 1.

* * * * *